US006826285B2

(12) United States Patent
Azima

(10) Patent No.: US 6,826,285 B2
(45) Date of Patent: Nov. 30, 2004

(54) BENDING WAVE LOUDSPEAKER

(75) Inventor: Henry Azima, Cambridge (GB)

(73) Assignee: New Transducers Limited, London (GB)

( * ) Notice: Subject to any disclaimer, the term of this patent is extended or adjusted under 35 U.S.C. 154(b) by 23 days.

(21) Appl. No.: 09/920,322

(22) Filed: Aug. 2, 2001

(65) Prior Publication Data

US 2002/0044668 A1 Apr. 18, 2002

Related U.S. Application Data

(60) Provisional application No. 60/223,410, filed on Aug. 4, 2000.

(30) Foreign Application Priority Data

Aug. 3, 2000 (GB) ..... 0018996

(51) Int. Cl.[7] ..... H04R 25/00
(52) U.S. Cl. ..... 381/152; 381/426; 381/431
(58) Field of Search ..... 381/152, 431, 381/426, 398, 353

(56) References Cited

U.S. PATENT DOCUMENTS 6,160,898 A 12/2000 Bachmann et al.

FOREIGN PATENT DOCUMENTS

| | | | |
|---|---|---|---|
| DE | 198 21 855 | A1 | 11/1999 |
| EP | 0 541 646 | | 1/1995 |
| EP | 0 924 960 | A2 | 6/1999 |
| EP | 0 847 661 | | 11/1999 |
| WO | WO 97/09842 | A2 | 3/1997 |
| WO | WO 99/52324 | A1 | 10/1999 |
| WO | WO 00/07409 | A1 | 2/2000 |

*Primary Examiner*—Suhan Ni
(74) *Attorney, Agent, or Firm*—Foley & Lardner LLP

(57) ABSTRACT

A loudspeaker comprising a panel which is sufficiently stiff to support bending waves, the panel having a boundary, a transducer mounted to the panel to apply bending wave energy in the form of dispersive travelling waves thereto at a first location in response to an electrical signal applied to the transducer to cause the panel to vibrate and radiate an acoustic output, the loudspeaker having a frequency range extending from a lower frequency to a higher frequency and the panel having a stiffness giving a coincidence frequency above the lower frequency. Means on or associated with the panel at a second location attenuates travelling bending waves in the panel to prevent or at least substantially to moderate panel resonance.

30 Claims, 32 Drawing Sheets

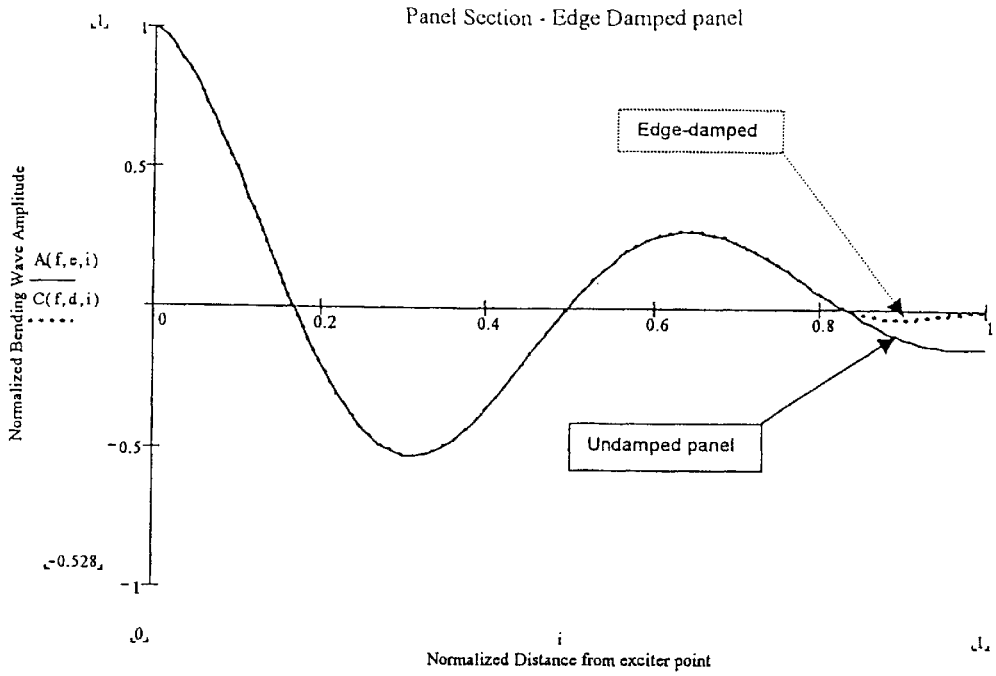
Figure 6. Bending wave expansion towards the panel edge. (Edge-damped panel) —
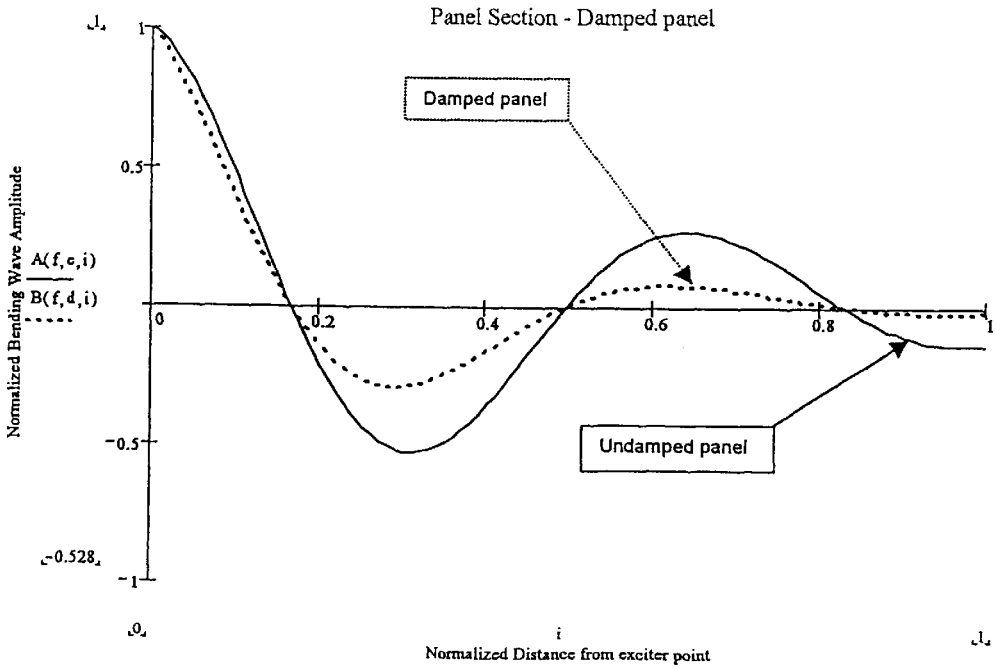
Figure 7. Bending wave expansion towards the panel edge. (damped panel).

Thin line = free panel, thick Line =with Damping Treatment

Thin line = free panel, thick Line =with Damping Treatment

Thin line = free panel, thick Line =with Damping Treatment

Thin line = free panel, thick Line =with Damping Treatment

Thin line = free panel, thick Line =with Damping Treatment

BENDING WAVE LOUDSPEAKER

This application claims the benefit of U.S. provisional No. 60/223,410, filed Aug. 4, 2000.

TECHNICAL FIELD

The invention relates to bending wave loudspeakers which are often flat panel loudspeakers.

BACKGROUND ART

Flat panel speakers and indeed most conventional speakers until recently have operated intentionally in a pistonic regime, but natural break-ups invariably caused unwanted interference with the intended mode of operation. Notably cone type loudspeakers suffer from a variety of shortcomings including limited bandwidth and beaming at the higher range of their operative bandwidth a phenomenon which is diaphragm size dependant.

Other flat panel speakers are known which use a stretched membrane type of diaphragm and which operate through propagation of constant speed waves across the panel surface. In this case too, natural dimensions, areal mass density and the membrane tension primarily decide the nature and extent of modality in the panel, although for most materials inherent membrane damping tends to reduce modality to some extent. This type of loudspeaker has some desirable acoustic properties, notably wide radiation pattern and reasonably wide bandwidth. However by the nature of the construction such loudspeakers are very difficult to make in consistent quality.

More recently, bending wave loudspeakers have been developed, see for example EP 0541,646 of Heron and EP0847661 of Azima et al, which rely on either a multimodal or a distributed-mode operation. In both these cases, especially in the latter case known as DML, which substantially defines the basis of a new form of wide-band loudspeaker using natural plate resonance to reproduce acoustic output, the modality is caused by the finite panel size and the ensuing build-up of modes primarily due to the dimensions of the panel, bending stiffness, and areal mass density of the material. It has been shown that this type of loudspeaker can exhibit desirable acoustic properties that were not possible to achieve in the prior art. In the case of distributed-mode loudspeakers, the lower frequency range can in some circumstances suffer from sparse modality which limits, at least for high-fidelity purposes, the speaker in its lower frequency range of operation.

SUMMARY OF THE INVENTION

It is the intention of the present invention to achieve a more effective use of bending waves for reproduction of sound especially in the lower operating range of the loudspeaker. It is an objective of this invention to avoid altogether or at least reduce the modal behaviour of the panel, either throughout the operating range or at least in the lower frequency range of operation. Ideally, the panel should behave as if it were infinite in size—that is no energy is reflected from the boundaries, despite its finite physical size. The core idea of the present invention is that the imposition of an acoustic aperture onto a conceptually infinite panel results in a net acoustic power available in the far field of the panel at below the coincidence frequency, and also above it.

It is well documented that an infinitely large panel operating in bending plane wave radiates little or no acoustic energy below its coincidence frequency (frequency at which speed of sound in the panel reaches that of its surrounding air (fluid)) To overcome this limitation, a distributed mode loudspeaker in effect imposes a finite mechanical aperture onto an infinite panel (by its finite size and boundary conditions), thus creating a modal object to achieve this effect. The effect of this aperture is to either present a zero (clamped edge) or infinite (free edge) mechanical impedance to the panel and therefore instigate reflections in order to build up natural resonant behaviour in the panel.

In contrast, the present invention stipulates substantially terminating the panel structure at the panel boundaries, ideally to absorb incident bending wave energy. This is tantamount to an infinite panel with a finite acoustic aperture imposed on it. This is a significant departure from the prior art and in fact an antithesis to a modal object.

Thus, according to the invention, there is provided a loudspeaker comprising a panel which is sufficiently stiff to support bending waves, the panel having a boundary, a transducer mounted to the panel to apply bending wave energy in the form of dispersive travelling waves thereto at a first location in response to an electrical signal applied to the transducer to cause the panel to vibrate and radiate an acoustic output, the loudspeaker having a frequency range extending from a lower frequency to a higher frequency and the panel having a stiffness giving a coincidence frequency above the lower frequency, and comprising means on or associated with the panel at a second location to attenuate travelling bending waves in the panel to prevent or at least substantially to moderate panel resonance, the attenuating means acting in the manner of an acoustic aperture over an infinite bending plate.

The attenuating means may comprise mechanical impedance means at a panel boundary and matched to the mechanical impedance of the panel to provide absorption of bending wave energy reaching the panel boundary. The attenuating means may be located on or in the panel to attenuate bending wave energy before it reaches the panel boundary. The attenuating means may be frequency dependent. The frequency dependence may be such that higher frequencies of bending wave energy are reflected from the panel boundary.

The mechanical impedance means may extend round substantially the entire panel boundary.

The attenuating means may comprise a predetermined stiffness or structural mechanical impedance profile across the panel.

The mechanical impedance means may increase bending wave energy absorption at, or bending wave energy transfer across, at least a portion of a boundary of the panel.

The attenuating means may provide a non-uniform or varying mechanical impedance profile across at least a portion of the panel.

The attenuating means may provide an increase in attenuation towards a boundary of the panel.

The attenuating means may provide a reduction in attenuation towards the centre of the panel.

The attenuating means may have a mechanical impedance which is substantially matched to a mechanical impedance at an interface between at least a portion of the panel and a frame for the panel.

The attenuating means may comprise a variation in panel thickness or density across at least a portion of the panel.

The attenuating means may comprise a layer over one or both surfaces of the panel and/or incorporated within the panel.

The bending wave panel may comprise a termination provided at or towards at least a portion of a panel boundary.

The termination may have a predetermined mechanical impedance for substantially terminating a mechanical impedance of at least a portion of the panel to an impedance of a portion of a frame for the panel. The termination may have a predetermined mechanical resistance for reducing the energy of a bending wave moving towards a panel boundary.

The first location may be at the panel centre.

From another aspect the invention is a microphone comprising a panel which is sufficiently stiff to support bending waves, the panel having a boundary, a transducer mounted to the panel to produce an electrical signal in response to bending wave energy in the form of dispersive travelling waves in the panel caused by incident acoustic radiation, the microphone having a frequency range extending from a lower frequency to a higher frequency and the panel having a stiffness giving a coincidence frequency above the lower frequency, and comprising means on or associated with the panel to attenuate travelling bending waves in the panel to prevent or at least substantially to moderate panel resonance, the attenuating means acting in the manner of an acoustic aperture over an infinite bending plate.

From a further aspect, the invention is an acoustic device comprising a panel which is sufficiently stiff to support bending waves, the panel having a boundary, the device having a frequency range extending from a lower frequency to a higher frequency and the panel having a stiffness giving a coincidence frequency above the lower frequency and comprising means on or associated with the panel to attenuate travelling bending waves in the panel to prevent or at least substantially to moderate panel resonance, the attenuating means acting in the manner of an acoustic aperture over an infinite bending plate.

There are two principal methods of achieving the objective of the invention. A bending wave object of the present invention, with the desired action, may use a combination of the two techniques.

Ideally the panel system should have a structure with a mechanical impedance all around its boundaries designed to terminate the mechanical impedance of the panel. This will result in the full absorption of the bending wave energy reaching the boundaries.

An alternative approach would be for the panel to incorporate sufficient and appropriate damping, either intrinsic or added on by the application of damping material to its surface or internal structure, to absorb the bending wave energy gradually as it radiates out from the exciter(s). Thus by the time the waves reach the boundaries they would have lost most or all their energy and hence cause little or no reflections.

In practice, a combination of the above two techniques may be used to achieve the desired performance. In both cases, the damping structure may be deliberately designed by specifying the material and/or the structure of it to be frequency dependent in order to achieve a given acoustic target—for example it may be desirable for the panel to become modal at higher frequencies.

According to both of the above mentioned approaches, the damping can be incorporated in or around the panel so as to significantly reduce the energy of the bending waves at, or as the waves approach, the periphery of the panel. However, neither of the above mentioned approaches involves the incorporation of damping such that the efficiency of the panel is unduly compromised. Damping of a desired kind can be achieved by having a predetermined stiffness or structural impedance profile across the panel or by the inclusion of forms of edge termination.

In one form of the present invention, a bending wave panel is provided with a medium for reducing the reflection of bending wave energy from at least a portion of a boundary of the panel.

In another form of the bending wave panel of the present invention, there is a gradual reduction or increase in damping or impedance across a panel.

In another form of the bending wave panel of the present invention, a reduction or increase in damping or impedance across a panel is substantially linear.

In another form of the bending wave panel of the present invention, a reduction or increase in damping across a panel is substantially non-linear and can be, for example, exponential.

In another form of the present invention, a bending wave panel comprises a medium which presents an impedance to a bending wave in the panel.

References herein to impedance include references to reactance and/or resistance.

References herein, both explicit and implicit, to acoustics or sound include references to infrasound and ultrasound.

The present invention is not limited to application in loudspeakers but can also be applied to other acoustic transducers such as microphones, couplers and the like.

BRIEF DESCRIPTION OF THE DRAWINGS

Examples that embody the best mode for carrying out the invention are described in detail below and are diagrammatically illustrated in the accompanying drawings, in which:

FIG. 6 is a graph plotting a bending wave in an edge damped panel;

FIG. 7 is a graph plotting a bending wave in a damped panel;

DETAILED DESCRIPTION

Many materials are readily available today whose behaviour, for example modulus or loss factor, can be tailored by design to be dependent or independent of frequency and/or temperature. The choice of the right material with correct absorption factor in the main two methods described should be relatively easy to suit the manufacturing process and the cost in mind.

The edge termination may be achieved in many ways, however, in all the various schemes useful performance may be reached by the application of gradual damping obeying either a simple linear function or more ideally an exponential law. The latter can provide a smaller area of panel treated with damping material.

It is also desirable to mould the damping material onto the panel for better consistency and lesser cost, if the design lends itself to injection moulding processes. In some cases it may be preferable to terminate the panel with a damping material which has an open structure in order to prevent any unwanted radiation from it.

Materials that allow control of damping with frequency may be found very useful in configuring the optimum behaviour of the panel to suit the application. For example, it may be desirable to allow the panel to behave in a DM fashion for acoustical reasons in part of the frequency range.

Internal Damping

By internal damping is meant that damping is applied to the panel remote from the panel edge. In this case a variety of methods can be applied in the construction of the panel in order to add the required damping. The idea here is for the bending waves to be attenuated sufficiently by the time they reach the extremities of the panel in order to avoid reflection from the edges. These may take many forms including:

a) Using a monolithic panel with high inherent damping;
b) Adding a layer of damping material to the panel, which may be a composite or monolith panel: this may be a simple layer of damping foam or applied as a coating;
c) Using the damping layer as a layer in the construction of the panel, e.g. as the adhesive layer or the core material; or
d) As part of an injection moulding process added to the base material in foaming or as a co-moulding process.

Figure 1A:
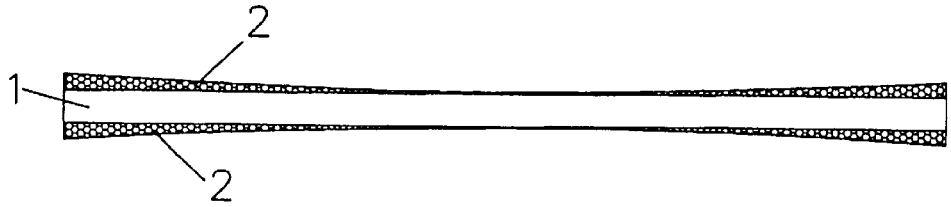
FIGS. 1*a* to 1*h*, 1*j* and 1*k* are cross-sectional side views of various embodiments of bending wave panel.
Figure 1B:
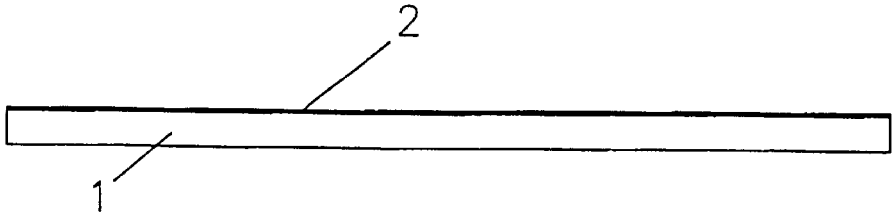
Figure 1C:
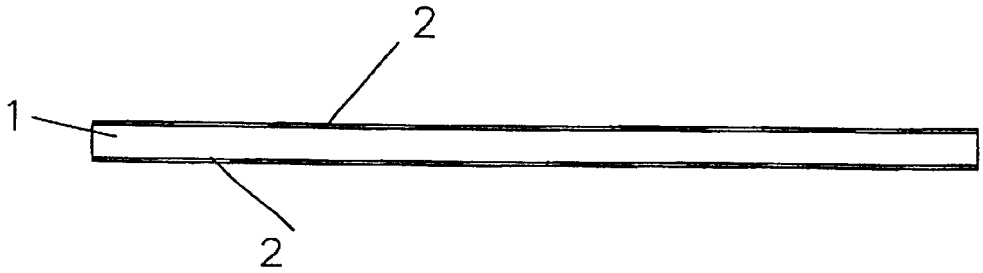
Figure 1D:
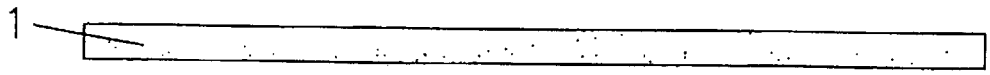
Figure 1E:
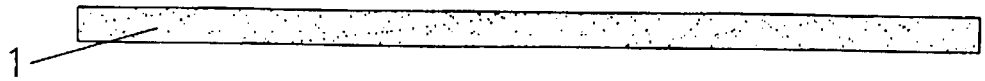
Figure 1F:
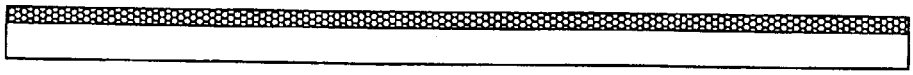
Figure 1G:
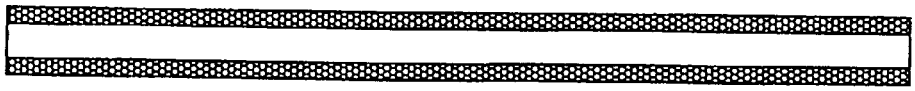
Figure 1H:
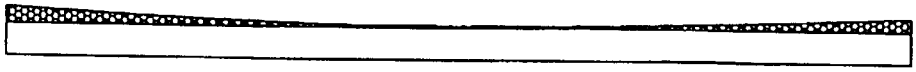

Surface damping can be achieved by the application of a variety of common as well as esoteric materials. The surface mass density of the material is an important parameter which should be minimised to achieve efficiency. Appropriate materials include polymeric foams of open or closed structure, fabrics, PVC, thin natural or synthetic leathers, paper based materials, surface coatings of liquid materials and the like. FIGS. 1*a* and 1*h* show the application of a damping layer 2 of varying thickness to one or both surfaces of a panel. FIGS. 1*b,* 1*c,* 1*f* and 1*g* show a damping layer of uniform thickness provided on one or both surfaces of a panel 1. Alternatively, or in addition to the provision of a damping layer on one or both surfaces of the panel, one or more damping layers can be incorporated into the structure of the panel itself. Alternatively, a panel 1 can be formed of a monolithic or composite low loss material, as is shown in FIG. 1*d,* or a high loss material, as is shown in FIG. 1*e.*

Internal and structural damping can be designed into the panel with an appropriate choice of damping material for the application, for example in terms of panel size, i.e. the damping should be sufficient to reduce bending wave energy reflections from the boundaries to useful levels. To optimise performance over-damping should in general be avoided.

Figure 1J:
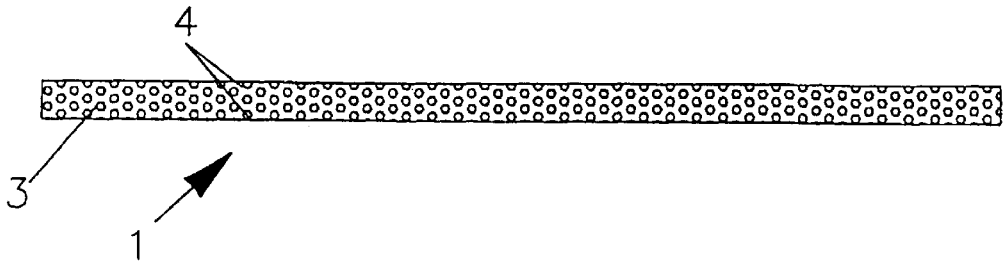
Figure 1K:
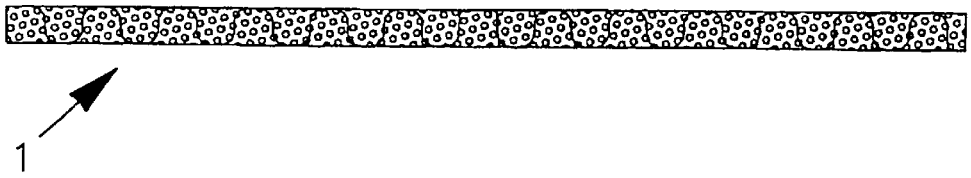
Figure 1L:
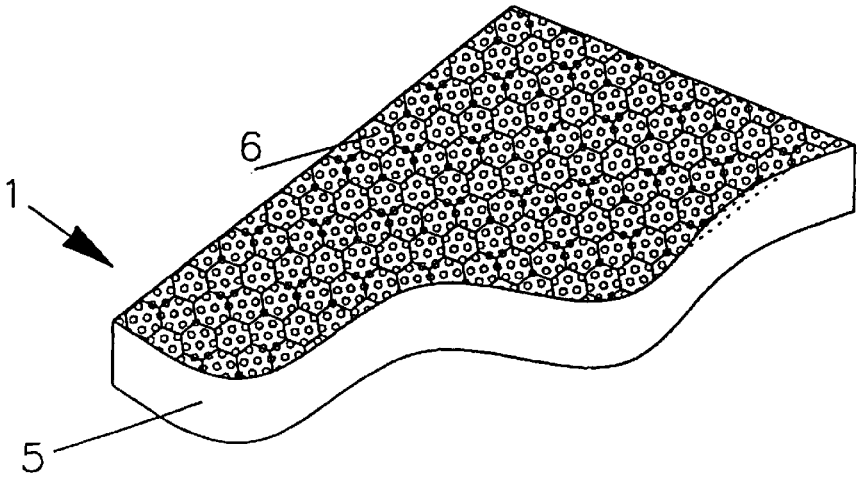
FIG. 1*l* is a perspective view of part of an embodiment of bending wave panel.

By way of an example, polyurethane in general makes for a better self-damped foam core than a polyester material in a sandwich construction. FIG. 1*j* shows a panel 1 having a polyurethane foam core 3 and face skins 4. Two other structural damping strategies may be adopted, in which a damping material is injected in the core cavities in order to provide for suitable and adequate damping which is appropriate for the application. FIG. 1*k* shows a self-skinned extruded panel 1 according to a first of the structural damping strategies, while FIG. 1*l* shows a panel 1 having a honeycomb type core 5, and face skins (not shown) according to a second of the structural damping strategies and into which damping foam 6 has been injected. If the injected material is light and flexible, then the other properties of the panel, for example the stiffness and areal mass density, do not change appreciably as a consequence of a modification of the panel damping to suit the design requirements.

Figure 2A:
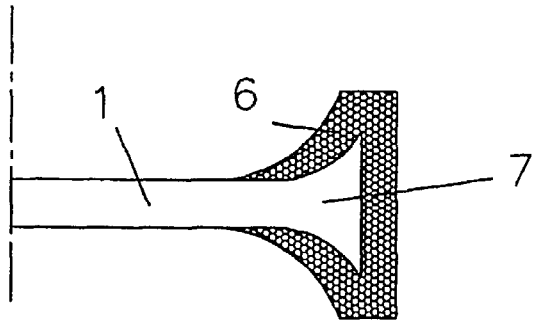
FIGS. 2*a* to 2*h* and 2*j* to 2*n* are partial cross-sectional side views of embodiments of the edges of bending wave panels.
Figure 2B:
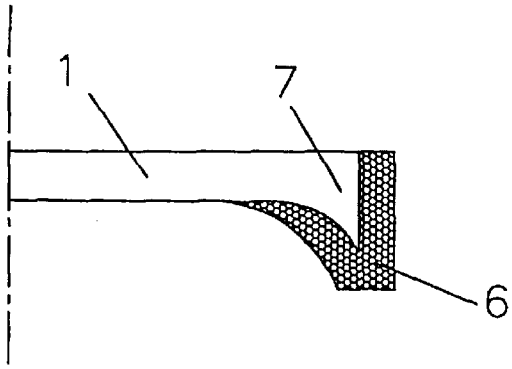
Figure 2C:
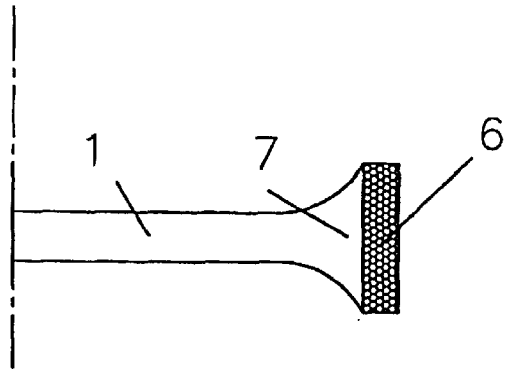
Figure 2D:
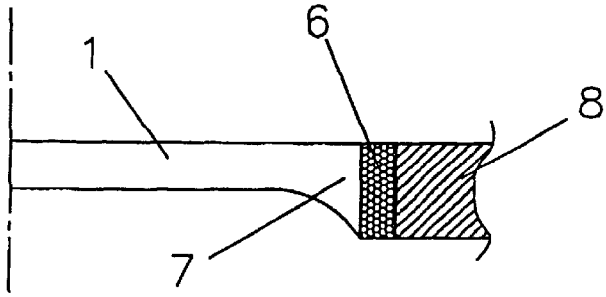
Figure 2E:
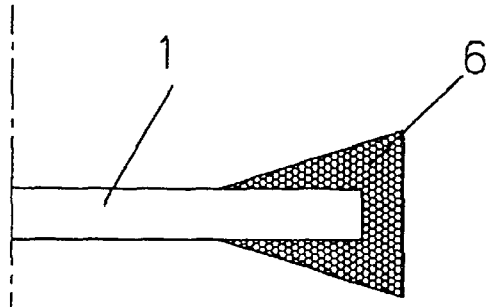
Figure 2F:
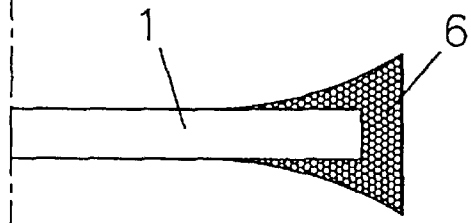
Figure 2G:
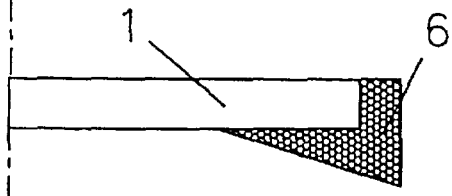
Figure 2H:
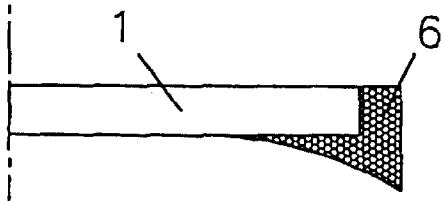
Figure 2J:
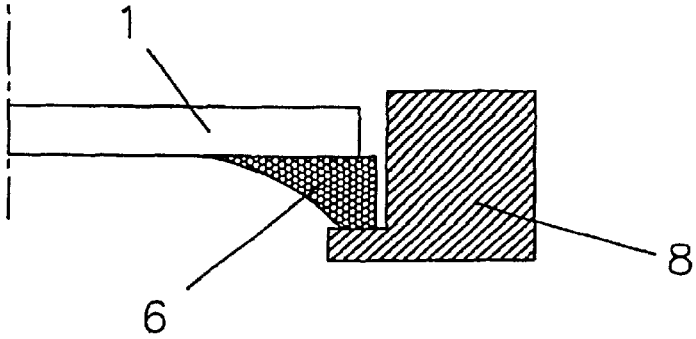

Edge damping can be thought of and modelled as a mass spring and dashpot system. More particularly, edge damping can be considered as a series of spring/dashpot systems which gradually increase in their magnitude. The spring and dashpot system can be applied at the edge of the panel, in the edge region, or in an area of the panel where the radiation from the panel needs to be minimised. FIG. 2*a* to 2*n* show means by which radiation or reflection from the edge region of a panel can be minimised.

According to one approach the stiffness should increase as the edge termination is approached. The stiffness should increase in a gradual fashion to avoid abrupt mechanical impedance changes and the consequent reflections. The damping may also be increased in the same fashion. It is desired that the amplitude of the bending waves gradually reduce to zero as the waves approach the edge of the panel. FIGS. 2*a* to 2*j* show panels 1 having edge damping 6 which forms the means by which the magnitude of bending waves can be gradually reduced as the waves approach the edge of a panel. Panel stiffness in FIGS. 2*a* to 2*d* is increased in the panel edge regions 7 by locally increasing the panel thickness. In FIG. 2*d,* the damping material is fixed to a rigid frame 8. In the embodiments of FIGS. 2*e* to 2*g,* the panel 1 is of uniform thickness but the damping material 6 at its edge is of tapering thickness.

Figure 2K:
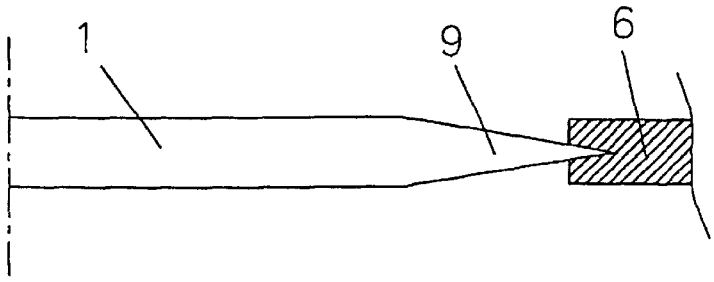
Figure 2L:
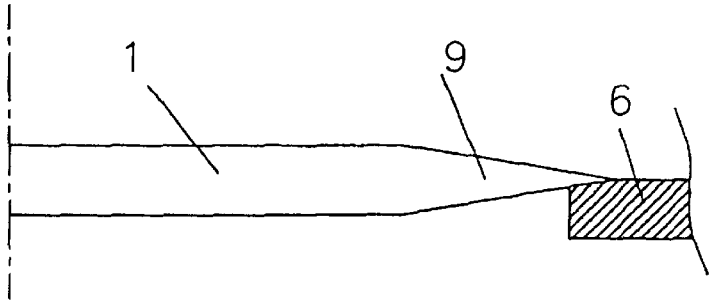
Figure 2M:
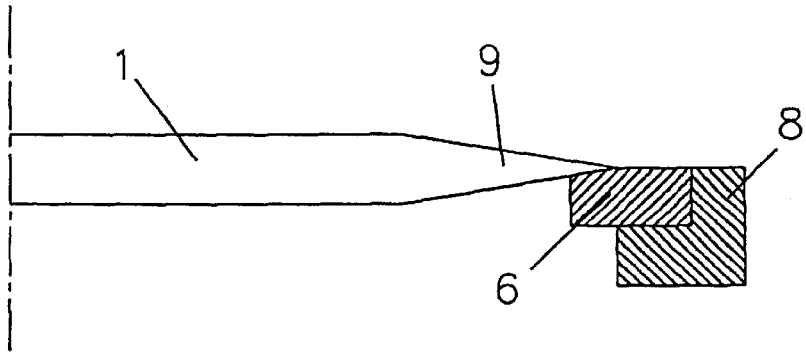
Figure 2N:
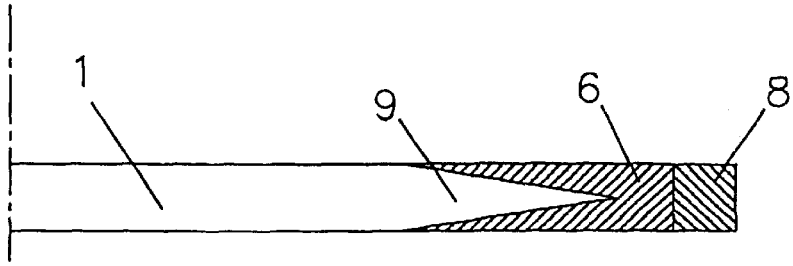
Figure 3A:
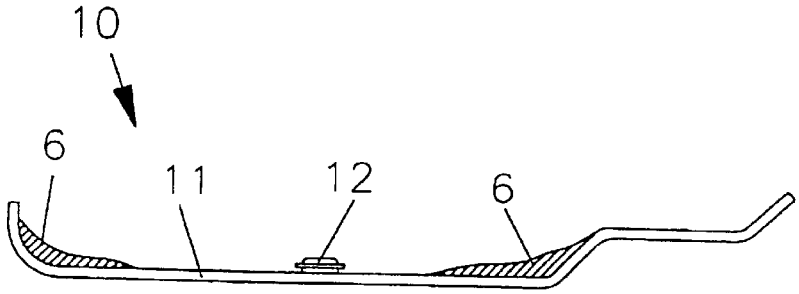
FIG. 3*a* is a cross-sectional edge view of a moulded interior trim panel, e.g. for an automobile, incorporating a loudspeaker of the present invention.
Figure 3B:
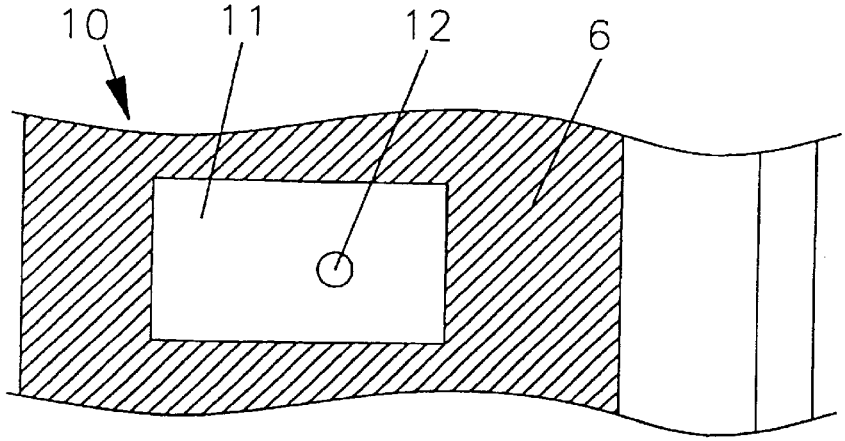
FIGS. 3*b* to 3*f* are front elevational views of embodiments of trim panel of the kind generally shown in FIG. 3*a;*
Figure 3C:
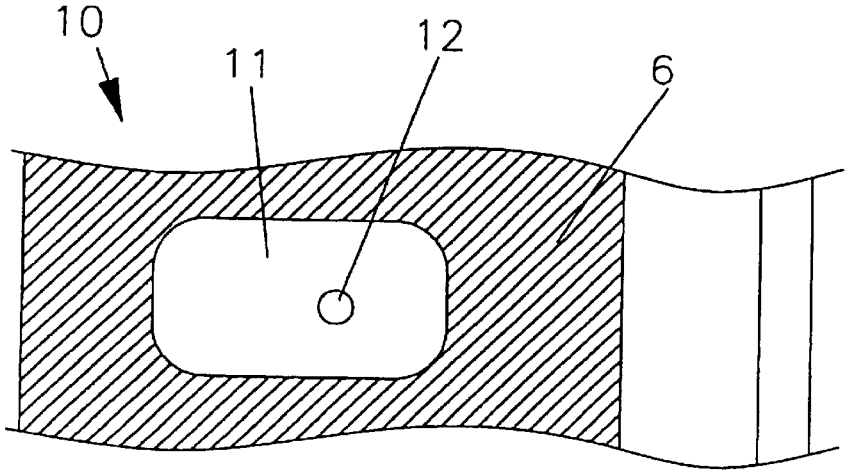
Figure 3D:
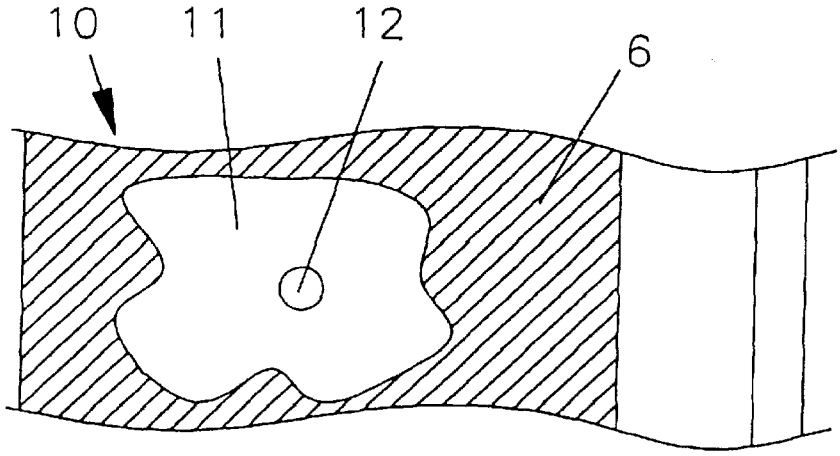
Figure 3E:
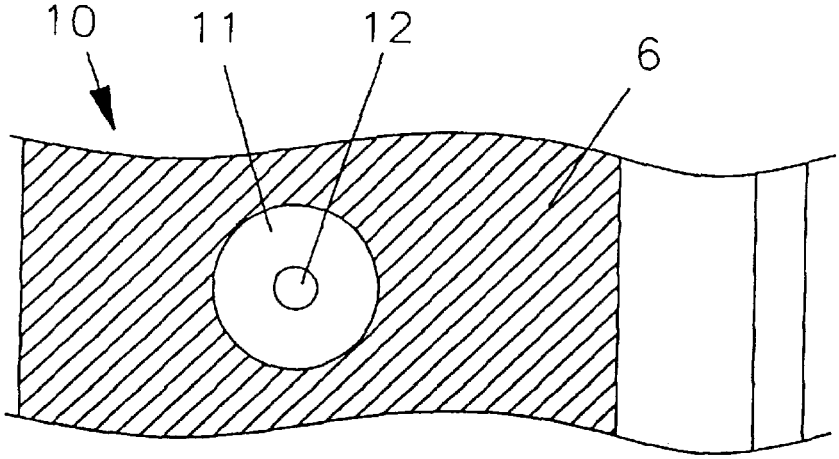
Figure 3F:
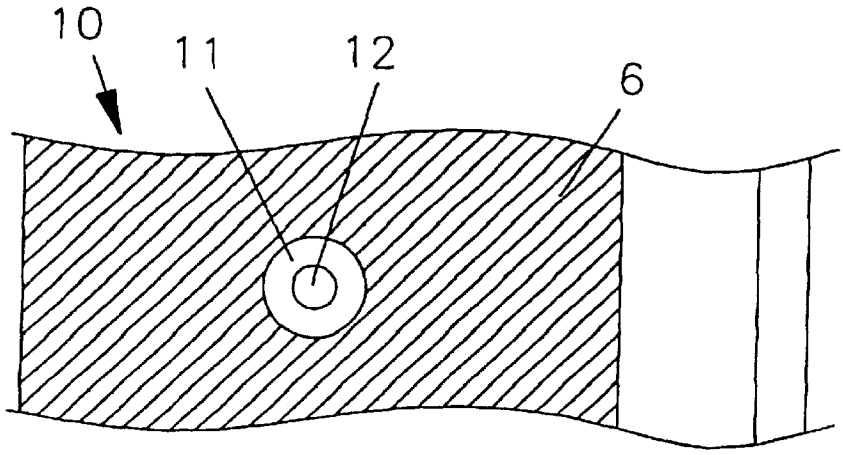

According to another approach, as shown in FIGS. 2*k* to 2*m,* the panel thickness, and therefore its stiffness, is reduced gradually towards the edges, as shown at 9. This results in a reduction in wave velocity in the edge region in combination with surface damping which is effective in absorbing the incident bending wave energy. The absorption of the incident bending wave energy can be enhanced by the use of a damping material which is effective at low frequencies.

Internal moulded panel trims and structures of air and ground transportation vehicles, e.g. automobiles, provide a very useful application of this technique. As is shown in FIGS. 3*a*–3*f,* an automobile trim panel 10 formed with an acoustically active panel area 11 excited by a vibration transducer 12 can be isolated and its performance enhanced by applying damping 6 to the panel area outside the active area. This technique is also effective in many other applications where an active area of a structure functions as a loudspeaker, such as television cabinets, computer enclosures and the like.

Figure 4:
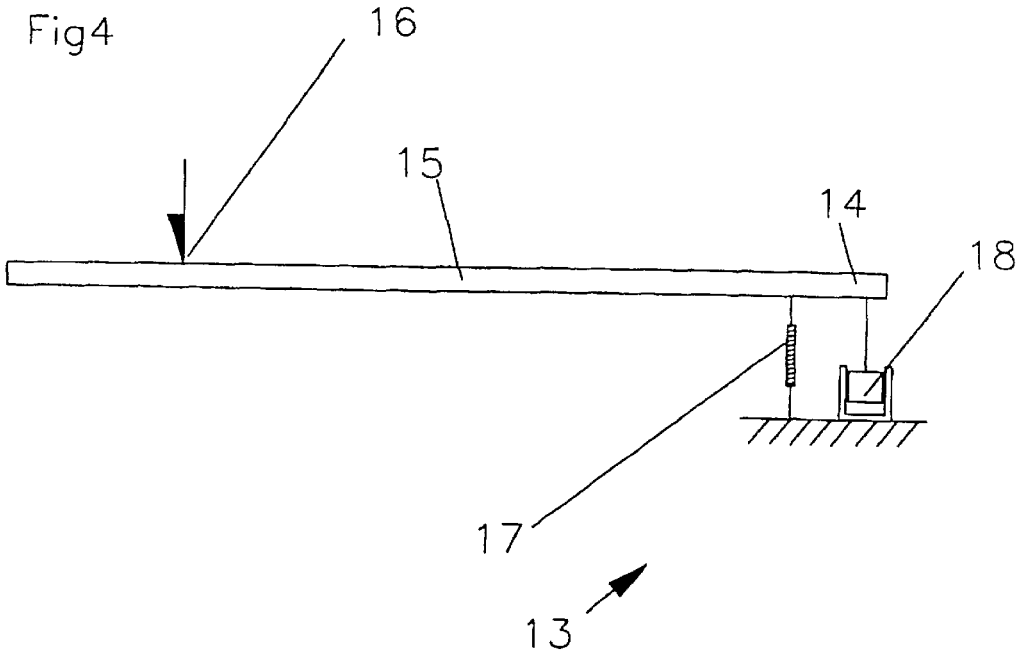
FIG. 4 is a schematic view of damping bending waves at a panel edge.

FIG. 4 is a schematic of a damping system 13 employed at an end or edge 14 of a beam 15 which is excited in vibration by a transducer indicated by arrow 16. However, the damping system shown in FIG. 4 can also be applied to a panel. In the damping system, a spring 17 represents stiffness and a dashpot 18 represents the damping or loss. In practice the damping system is more usually a distributed structure. It may be desirable that the stiffness and damping values vary across a panel and that the values vary, in particular, towards the extremities of the panel.

Figure 5:
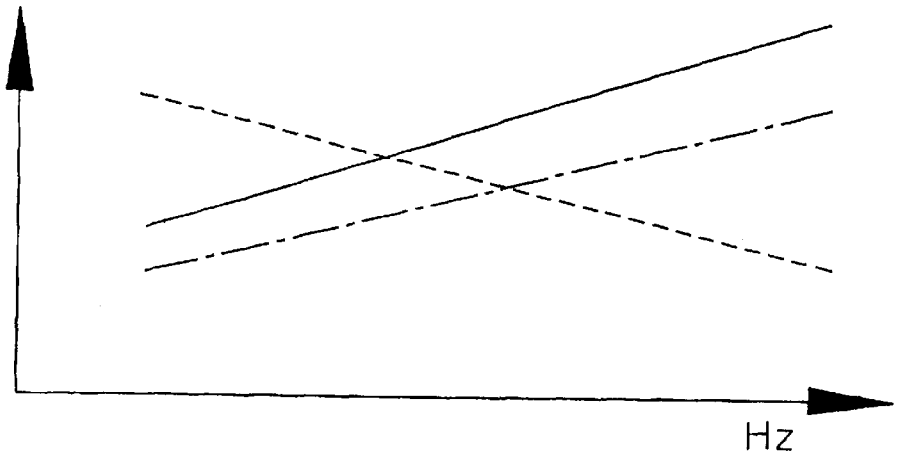
FIG. 5 is a graph plotting material with opposite damping properties against frequency.

Certain polymeric materials can be designed to provide the required stiffness and damping properties, which stiffness and damping properties are independent of each other with frequency. Such polymeric materials can be used to tailor the behaviour of the panel. For example, damping can be reduced at high frequencies in order to retain modality at these frequencies which suits the radiation characteristic of a particular application. FIG. 5 is a graph of the damping and stiffness properties of certain materials that can be controlled by design. Such materials can be used advantageously to achieve particular design goals for a panel loudspeaker. For example, if the material is specified to behave with 'damping factor (a)', then the damping will reduce with increasing frequency and the panel will become modal at high frequencies. Since the modes are normally quite dense at a higher frequency range and provide a diffuse radiation, this may be a desired design goal.

FIG. 6 is a graph of bending wave expansion across an edge damped panel towards the panel edge. As can be seen from FIG. 6, bending waves towards the edge of the panel still have high energy levels but meet a gradually increasing restraint or lossy stiffness as the edge of the panel is approached. The increase in stiffness and resistance causes a damping or loss which absorbs the energy of the bending wave in a gradual fashion such that there is little or no energy reflected from the panel edge. The edge damping can be achieved by providing the panel edge with a material with appropriate mechanical properties, for example as is shown in FIGS. 2*a* to 2*j.* Alternatively, edge damping can be achieved by forming the panel in a tapered or flared fashion, for example as is shown in FIGS. 2*a* to 2*d.* The tapered edge of the panel can have a linear or exponential profile on one or both sides of the panel. By following such an approach, an increase in the panel stiffness can be achieved, which increases the velocity of the bending wave. The increase in stiffness and the corresponding increase in damping causes a proportion of the energy of the bending wave to be dissipated by the time the bending wave reaches the panel edge. This technique can be used to make a panel with self-framing possibility.

FIG. 7 is a graph of bending wave expansion across a surface or implicitly damped panel towards the panel edge. As is shown in FIG. 7, the amplitude, and as a result the velocity, of the bending waves vary over the panel from the point of excitation to the edge of the panel. According to the implicitly damped panel approach, the panel has sufficient damping to absorb the bending wave energy as the waves travel from the point of excitation towards the edges of the panel. It is desired that the implicit damping is sufficient to cause the bending waves to lose most or all of their energy by the time the waves reach the panel edge. However, even if some of the incident energy is reflected from the panel edge it will not normally be sufficient to set up substantial resonant modes in the panel. Thus, little or no modal frequency preference can exist as a result of the finite dimensions of the panel. Therefore, little or no energy is reflected from the edges of the panel and that the panel only radiates the energy of the original bending wave which is generated in the first instance. As can be seen from FIG. 7, the amplitude of the bending wave for the 'undamped' panel reduces as the wave propagates towards the edge of the panel. It should be noted that the reduction in amplitude is due to the wave expansion and not loss of energy.

Reverberation Coloration

The provision of implicit or areal damping and of edge damping in panels provides in certain circumstances a yet further advantage over the low-loss DML panel. The panel resonance, so long as the panel reverberation time is generally less than substantially 10 mS, is not particularly audible and can add to the spaciousness of the sound. However, in low-loss panels, or small panels with very low stiffness and low bending wave velocity, the reverberation time in the panel can exceed the audible threshold. Therefore, the sound takes an echo-type coloration which can detract from the quality of the sound and from good intelligibility. The damping methods described herein can reduce or even eliminate this effect. The sub-optimal application of damping goes a long way towards reducing the aforementioned problems.

Free Layer Damping

Some background theory concerning application of a damping layer to a plate is now given. The application of such treatment to the panel is very effective in providing broadband damping to the panel as shown by the embodiment of the invention described below. Applications of individual strips of foam to a panel produces energy absorption at specific frequencies dependent upon the mechanical properties and dimensions of these damping layers as detailed below.

Viscoelastic materials, with mechanical properties having a time-dependence, are often applied either as a liquid coating or in sheet form directly to plates or panels in order to increase the damping properties of a system in order to reduce or eliminate unwanted vibrations. When a viscoelastic layer is applied directly to a vibrating plate without any constraint on the viscoelastic layer, it is termed 'free layer damping' and the damping layer principally operates in extension/compression parallel to the panel surface. The effects of free layers on the vibration characteristics of plates is well researched and documented. The effectiveness of the damping treatment is governed by the composite loss factor as given in Equation 1:

$$\eta_s = A\frac{E_2}{E_1}\left(\frac{H_2}{H_1}\right)^2\eta_2 \qquad \text{Equation 1}$$

where $\eta s$: System Damping Factor

A: Constant for System $H_1$: Base Layer Thickness $H_2$: Free Layer Thickness $E_1$: Base Layer Young's Modulus $E_2$: Free Layer Young's Modulus $\eta_2$: Free Layer Damping Factor Therefore, in very simple terms, the system loss factor increases with the free layer thickness (relative to the base layer), the free layer modulus (relative to the base layer) and the free layer damping. However, this general equation does not cover all configurations. In general terms, it is found that the free layer damping method is 'locally reacting' so that if a panel is covered completely by a free layer treatment, the effect should not depend upon mode shape or frequency but provides relatively broadband energy absorption.

However for cases where a free layer is applied only to a specific region of a panel, there will be a resonant frequency associated with this layer dependent upon the free layer thickness, modulus in tension/compression, density and free layer damping. A general form of the equation is given in Equation 2:

$$f_r \propto \sqrt{\frac{K}{M}} \qquad \text{Equation 2}$$

where $f_r$=resonant frequency (Hz)

K=effective stiffness in tension/compression

M=mass of free layer

The effective stiffness of the free layer is governed by Equation 3 given below:

$$K \propto \frac{E\,A}{t} \qquad \text{Equation 3}$$

where

E=Young's modulus in tension/compression

A=surface area of free layer t=thickness of free layer

Free layer damping applied to the whole surface of a plate provides broadband damping as described by Equation 1.

Strips or discrete pieces of free layers can be used in specific regions of the panel surface to provide energy absorption at a controlled level and over a controlled frequency range.

Edge Absorption

The aim of edge absorption is to absorb some or all the energy incident on an edge from an exciter.

The waves emitted by the exciter spread out across the bending wave plate with distance. By the time they reach the edge of the panel their curvature is greatly reduced, and they approximate to a plane wave. This plane wave approximation is valid over most of the length of the boundary, and best when furthest from the corners of the panel.

The plane wave approximation greatly simplifies the problem as it becomes one-dimensional, i.e. a plane wave incident on a parallel boundary. The problem can therefore be addressed by considering a one dimensional (1D) beam, the waves propagating along it, and the termination at the edge. It is important to note that the experiment and theory following does not mean that the analysis is restricted to beam-like panels.

A 1D Beam Terminated by Impedance

Figure 8:
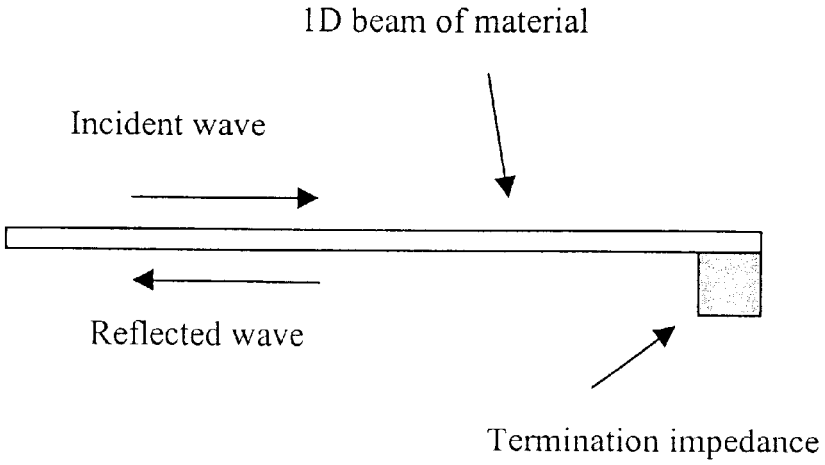
FIG. 8 is a schematic diagram of an end damped beam.

Consider the arrangement illustrated in FIG. 8. This arrangement is a transmission line problem comprising the following:

(a) a 1D waveguide;

(b) a wave incident on the edge;

(c) a termination impedance, and (d) a wave reflected at the edge.

It is straightforward to solve this problem, provided the boundary conditions at the edge are known, which are the following:

(a) the termination impedance only couples into the lateral velocity, i.e. it does not provide any torque resistance, which in turn makes the bending moment equal to zero at the edge, and (b) the ratio of the lateral shear force and the velocity at the edge is equal to the terminal impedance. This gives the following result for the reflection coefficient at the edge:

$$R = \frac{-\frac{Z_T}{Z_B} - i}{\frac{Z_T}{Z_B} + 1},$$

Where $Z_T$ is the termination impedance of the foam and $Z_B$ is the mechanical impedance of the end of the beam, given by:

$$Z_B = \frac{Bk^3}{2\omega}(1 + i)$$

Here B is the material bending stiffness, ω the angular frequency, and k the wavevector of the bending waves given by the standard bending wave dispersion relation ($\mu$ is the material surface density):

$$k = \sqrt{\omega\sqrt{\frac{\mu}{B}}}\,.$$

The following is noted from this equation:

1. the ratio of beam end impedance to the termination impedance determines the reflection coefficient;
2. The beam impedance is frequency dependent, and is proportional to the square root of frequency;
3. the beam impedance is both real and reactive in equal weights (i.e. 45 degree phase angle), and
4. the reflection coefficient is likely to be strongly frequency dependent.

These factors help the engineer/design beam terminations.

EXAMPLE 1

Pure Resistive Damping

For this first case consider a typical panel material, with a pure resistive damper on the edge; the material is 5 mm thick acoustic 66, which is a phenolic paper composite with a honeycomb core, with material parameters as follows:

$$B=18.4 \text{ Nm}$$

$$\mu=0.44 \text{ kgm}^{-2}$$

Figure 9:
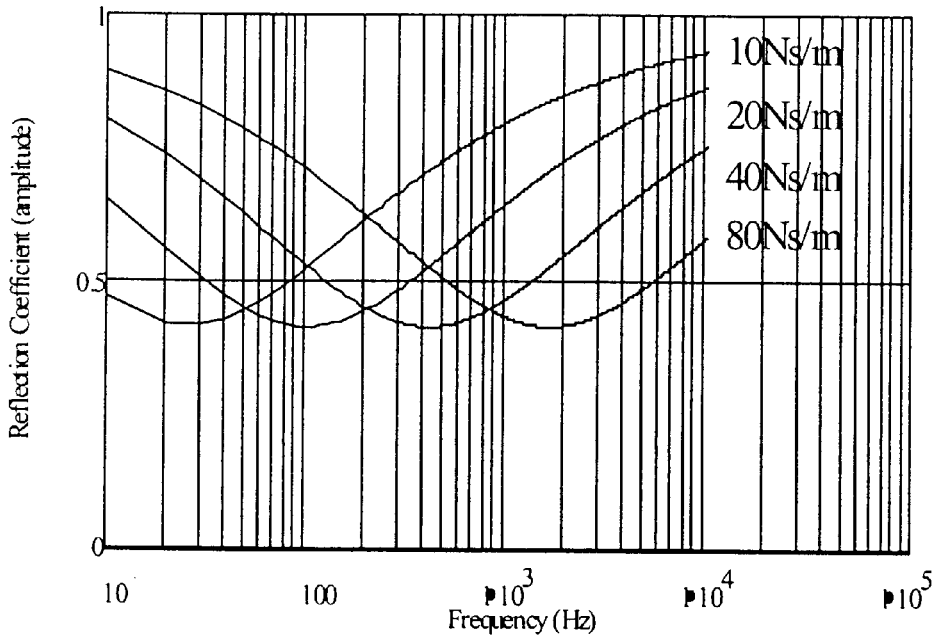
FIG. 9 is a graph of edge reflection coefficient as a function of frequency.

FIG. 9 shows the amplitude of the reflection coefficient as a function of frequency for a range of resistive dampers applied. This graph illustrates the following points of pure resistive damping:

1. The system shows a maximal absorption at a frequency that increases with the level of resistance applied;
2. The degree of absorption at this point is independent of the resistance and equal to 0.41; and
3. The maximal absorption is not 100% but is still useful.

Figure 10:
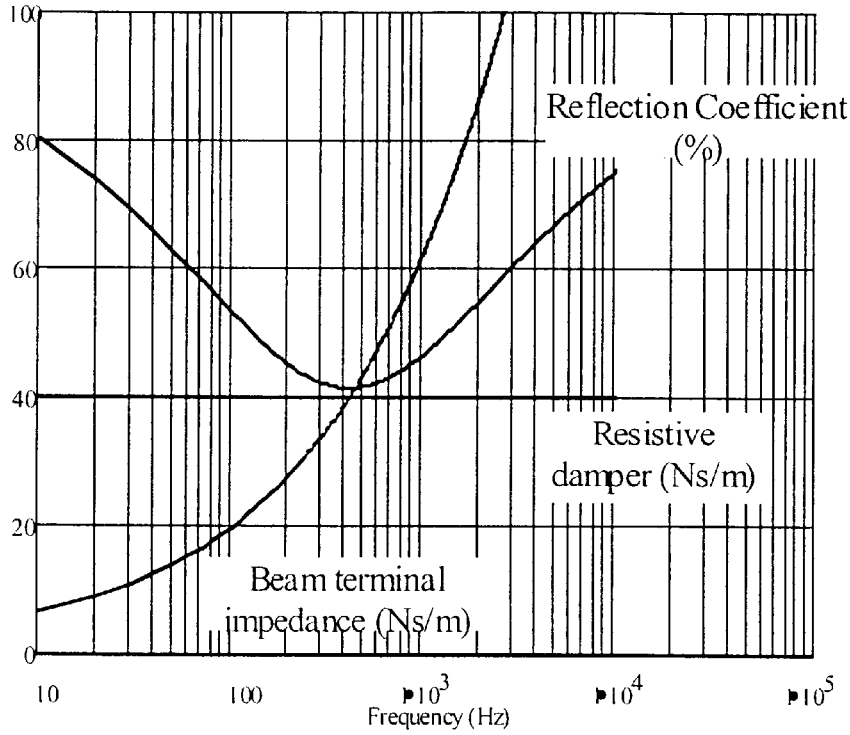
FIG. 10 is a graph comparing absorption maximum.

FIG. 10 shows the comparison of the modulus of the beam terminal impedance with the resistive impedance applied to the edge of the beam. It is clear that the absorption maximum occurs when these are equal, giving a reflection coefficient of 0.41 (41%). This graph illustrates the following:

1. With a pure resistive damper the minimum reflection coefficient is 0.41, occurring when the modulus of the beam terminal impedance equals the value of the resistive damper.
2. The value of the reflection coefficient tends to 1 either side of this frequency.
3. The phase of the reflection varies from $-\pi$ to $-\pi/2$ as the frequency increases.

EXAMPLE 2

Termination with a Resistance and a Compliance

The use of a complex impedance gives more flexibility and can in fact be used to terminate the beam, for example over a narrow frequency band.

In order for the reflection coefficient to equal zero the following relationships should be satisfied:

$$\frac{-\frac{Z_{Tl}}{Z_B}-i}{\frac{Z_T}{Z_B}+1}=0$$

$$\Rightarrow \frac{Z_T}{Z_B}=-i$$

$$\Rightarrow \mathrm{Re}[Z_T]=\mathrm{Im}[Z_B] \quad \mathrm{Im}[Z_T]=-\mathrm{Re}[Z_B]$$

Figure 11A:
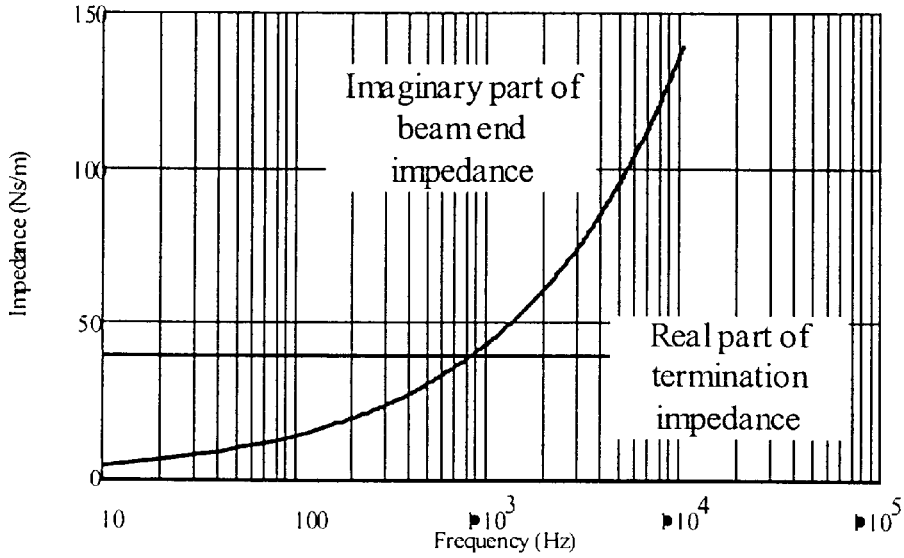
FIGS. 11*a* and 11*b* are graphs of termination impedance and beam impedance.
Figure 11B:
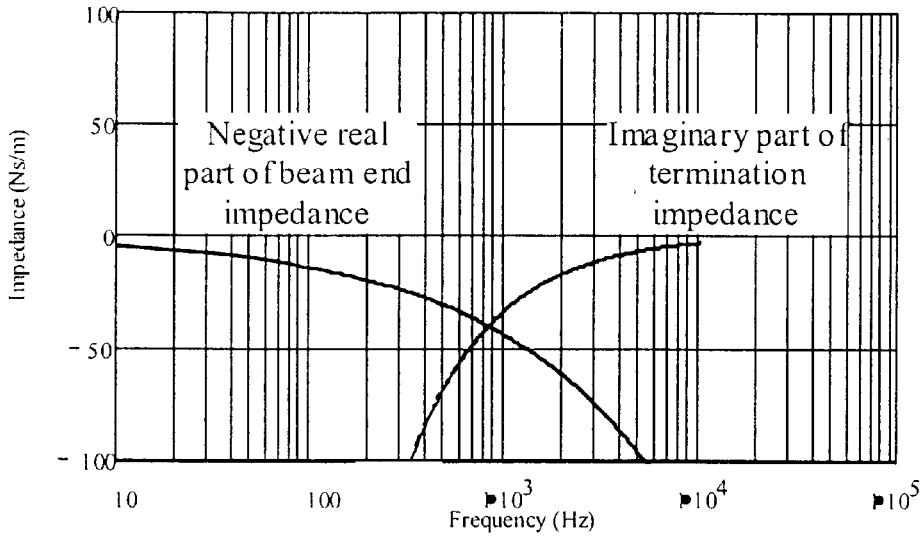

Termination of the beam with an impedance with both compliant and resistive components allows this condition to be fulfilled, as shown in FIG. 11. FIG. 11*a* shows the (x) that is the real part of the termination impedance versus imaginary part of the beam impedance, and FIG. 11*b* shows the (y) that is the imaginary part of the termination impedance versus the negative of the real part of the beam impedance. The parameters of the termination are:

Mechanical resistance=40 Ns/m;

Compliance=$\mathbf{4.8\times10^{-6}}$ N/m.

Figure 12A:
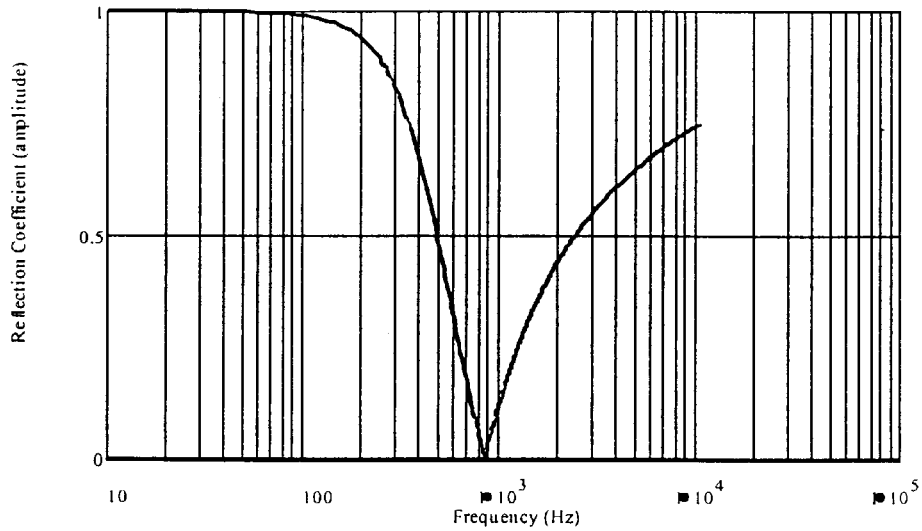
FIG. 12*a* is a graph showing the amplitude of the reflection coefficient.
Figure 12B:
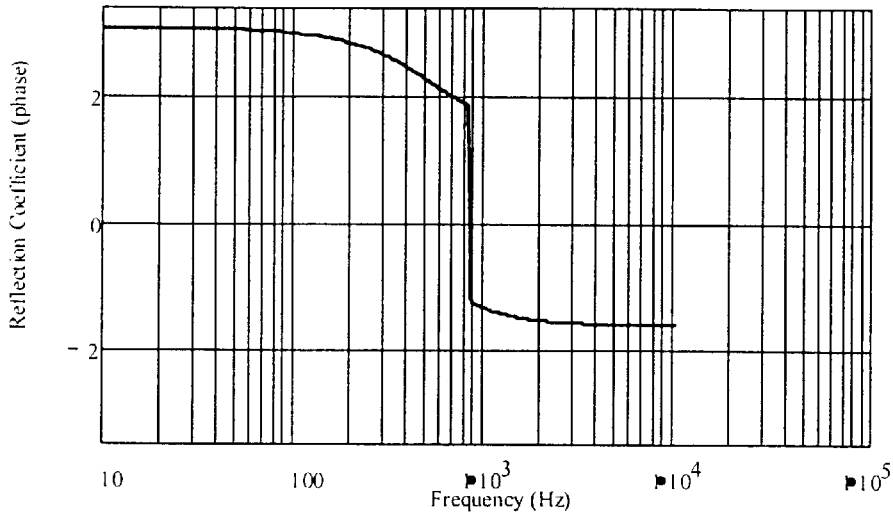
FIG. 12*b* is a graph showing the phase of the reflection coefficient.

With this choice of parameters, the above conditions are met at 820 Hz. The reflection coefficient calculated and shown in FIGS. 12*a* and 12*b* shows the expected null at this frequency The phase of the reflection under these conditions varies from $\pi$ to $-\pi/2$.

Figure 13A:
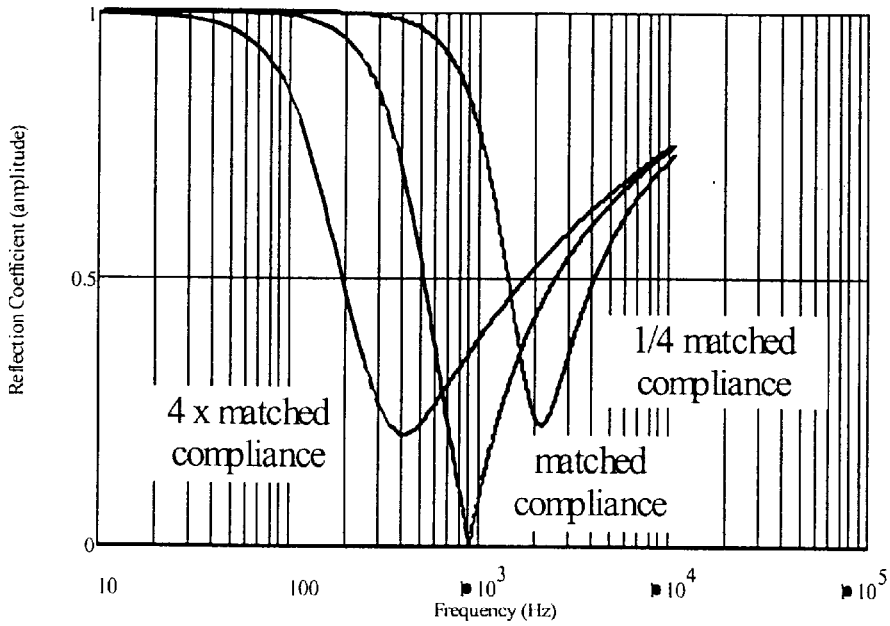
FIG. 13*a* is a graph showing the amplitude of the reflection coefficient.
Figure 13B:
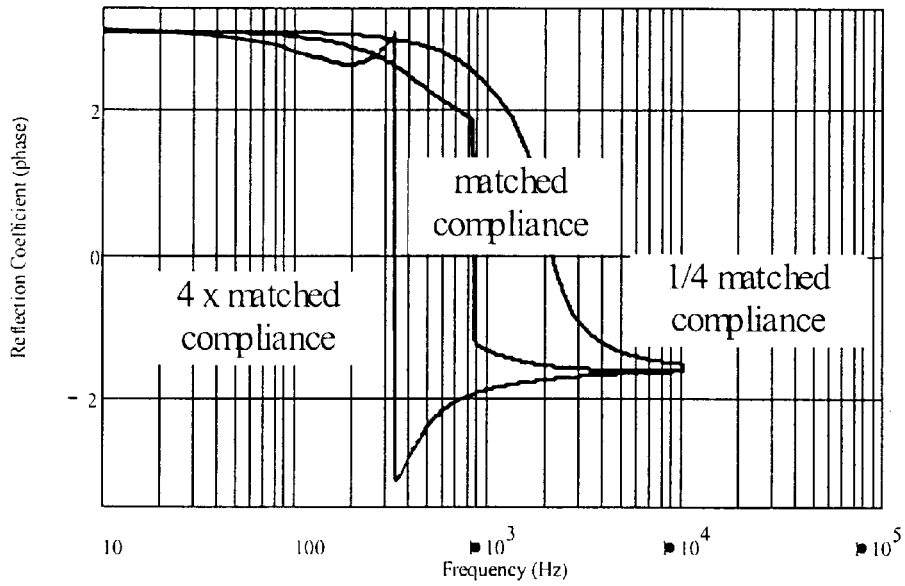
FIG. 13*b* is a graph showing the phase of the reflection coefficient.
Figure 14A:
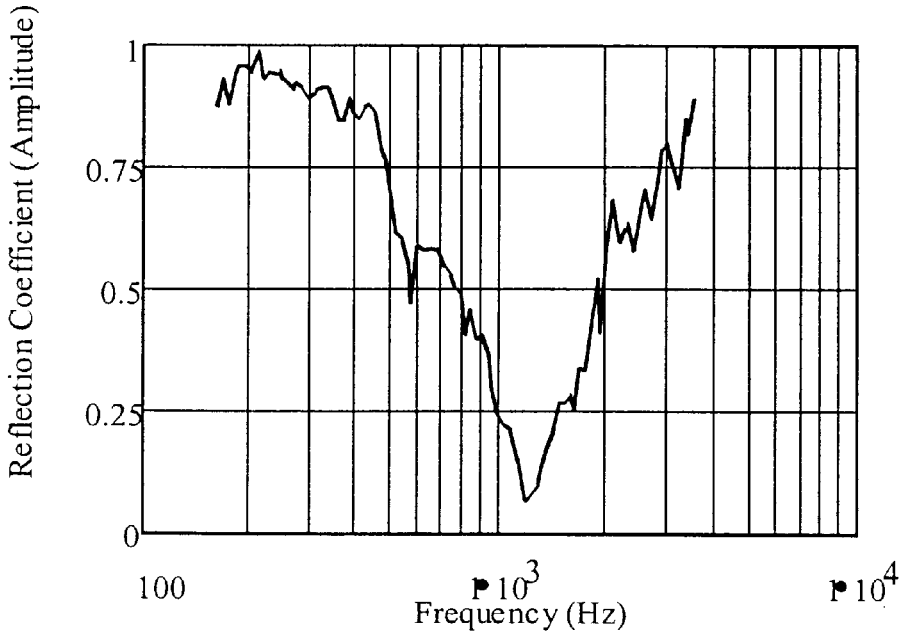
FIG. 14*a* is a graph showing the amplitude of the reflection coefficient.
Figure 14B:
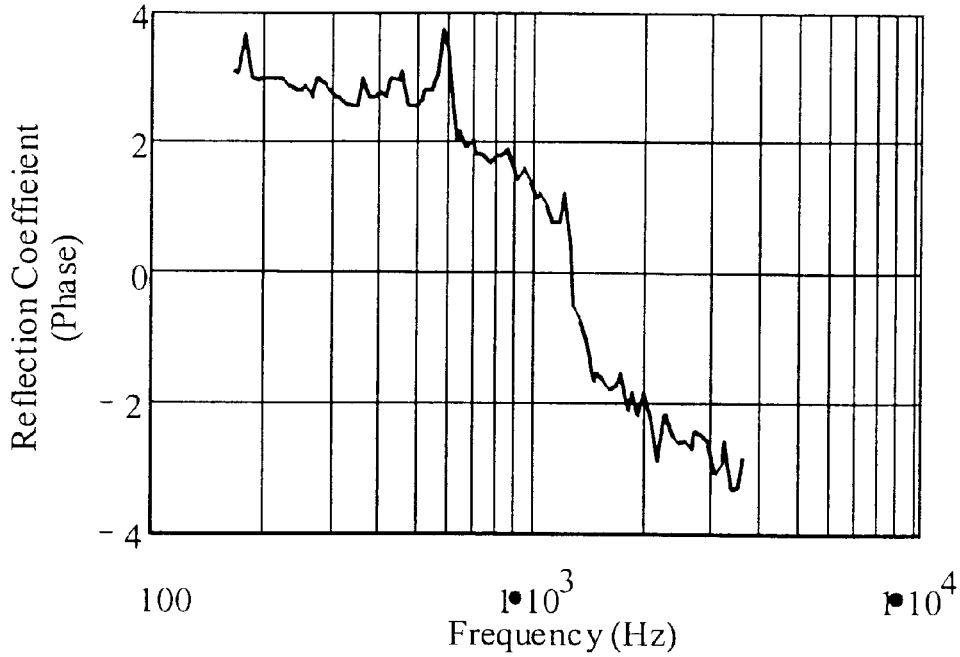
FIG. 14*b* is a graph showing the phase of the reflection coefficient.

When the values of the resistance and compliance are not perfectly matched in this manner, the absorption is less than maximum. This is shown in FIG. 13*a* and 13*b,* where the compliance is varied both above and below the optimally terminated compliance. It is also evident that the frequency and value of the reflection coefficient is determined by the compliance chosen.

The analysis indicates:

1. A complex impedance may be used to perfectly terminate the edge. This can be achieved with an impedance that has both resistive and compliant components.
2. If the edge is perfectly terminated the reflection coefficient becomes smaller and narrower in frequency.
3. The phase of the reflection varies from $\pi$ to $-\pi/2$ as the frequency increases.
4. If the resistance and compliance of the termination do not match those for the edge at any frequency, there is still a absorption maximum, however it is not as deep and its frequency and magnitude depend on the values chosen.

EXAMPLE 3

Termination with a Resistance, a Compliance and a Mass

The addition of a mass to edge termination impedance does not change the situation significantly. It is still readily possible to match the impedances at the edge for up to perfect absorption, however when considering the imaginary part of the termination impedance both the compliance and the mass should be taken into account. Again, when the termination impedance moves away from matched, the absorption shifts in frequency and depth. The phase of the reflection now varies from $\pi$ to $-\pi$.

When considering the termination of a panel with a practical damping foam the effective resistance, compliance, and mass of the foam are generally dependent on frequency. However, the characteristic behaviour and level of absorption that each foam/panel material combination shows can be assessed.

EXAMPLE 4

Termination with a Complex Impedance, Close to the Matching Criterion

For this case the system has been chosen to be Miers foam, which is a soft PVC predominantly closed cell foam, 5 mm thick terminating acoustic 66, 5 mm thick. This system behaves as a matched termination with compliant, resistive, and mass-like components, resulting in the sharp absorption shown in FIGS. 13*a,* 13*b,* 14*a* and 14*b* and a phase varying from $\pi$ to $-\pi$.

EXAMPLE 5

Termination with a Resistance

Figure 15A:
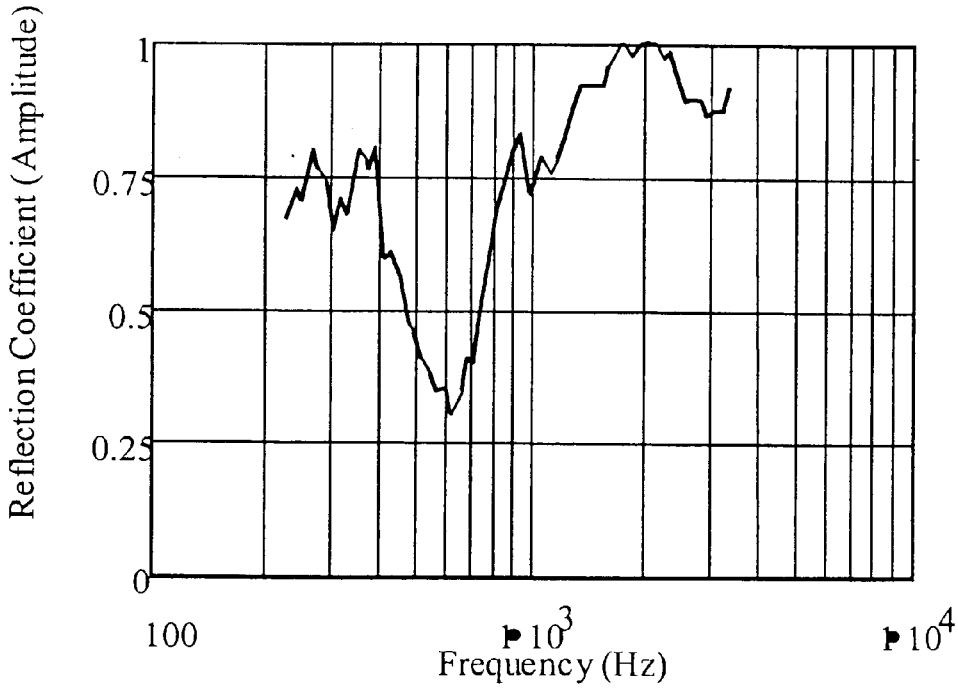
FIG. 15*a* is a graph showing the amplitude of the reflection coefficient.
Figure 15B:
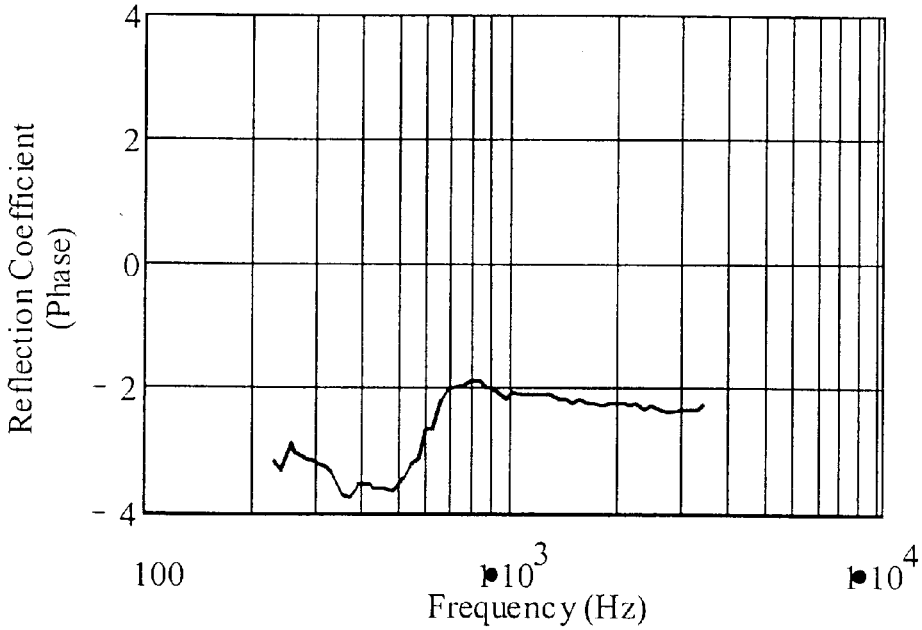
FIG. 15*b* is a graph showing the phase of the reflection coefficient.

For this example take a beam made from carbon fibre skins on an AL honeycomb core 5 mm thick. The beam is terminated with a synthetic polymer damper known for its high resistance Sorbothane 30 '00'. The resulting absorption coefficient is shown in FIG. 15*a* and 15*b,* demonstrating the characteristic phase and amplitude variation of a pure resistive termination. This is a minimum in amplitude of close to 0.4 absorption and a phase variation similar to $-\pi$ to $-\pi/2$.

Examples of the Effect of Energy Absorption Treatments on the Modal Behaviour of a Typical Bending Wave Panel The aim is to illustrate the effects of energy absorption treatments on a specific material in the form of a beam and then to extend this analysis to a full size panel.

A low damping, high stiffness beam was selected in order to illustrate the effectiveness of the energy absorbing treatments. A carbon fibre skin laminated onto an aluminium honeycomb core using epoxy adhesive was selected. Its mechanical properties are listed below in Table 1:

| Panel No. | Panel Thickness (mm) t | Panel Area1 Density (kg $m^{-2}$) $\mu$ | Bending Rigidity (Nm) in X-direction D1 | Bending Rigidity (Nm) in Y-direction D2 | Material Loss Factor $\eta$ |
|---|---|---|---|---|---|
| 1 | 5.25 | 0.882 | 82.83 | 82.83 | 0.0025 |

Beams of this material were then subjected to the following treatments and the properties of this beam were analysed as described below.

Effect of Edge Treatments on a Beam

Filled polymer film, consisting of a polymer having embedded lead particles, was applied across the whole surface of a beam of Table 1. The increased damping factor of this system is compared with the un-treated beam damping factor in FIG. 16.

Figure 16:
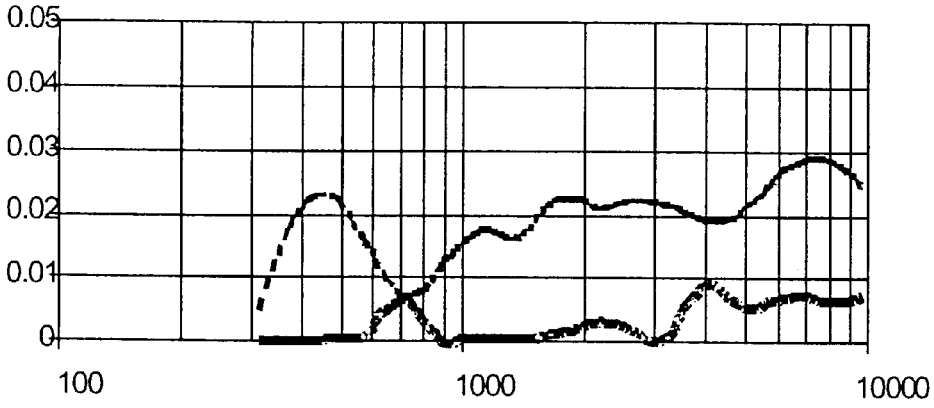
FIG. 16 is a graph comparing the damping factor versus frequency of an untreated and surface treated beam.

From FIG. 16 it is clear that the polymer damping layer has added considerable damping to the system from 300 Hz to 10 kHz. The average damping value of the un-treated beam in this frequency range was 0.003 whereas after treatment, the damping factor has increased to 0.0194 (a factor of 6.5 increase).

The filled polymer layer has added a broad level of damping across the whole surface of the beam but the measure of reflection coefficient is not significantly affected by the presence of the damping layer applied to the panel.

Low Modulas Foam Strips

As described above, a filled polymer layer applied to a panel produces a broad band damping effect. However, as described, it is also possible to apply strips of a low modulus foam material which absorb energy in specific regions of the panel and at particular frequencies.

Figure 17:
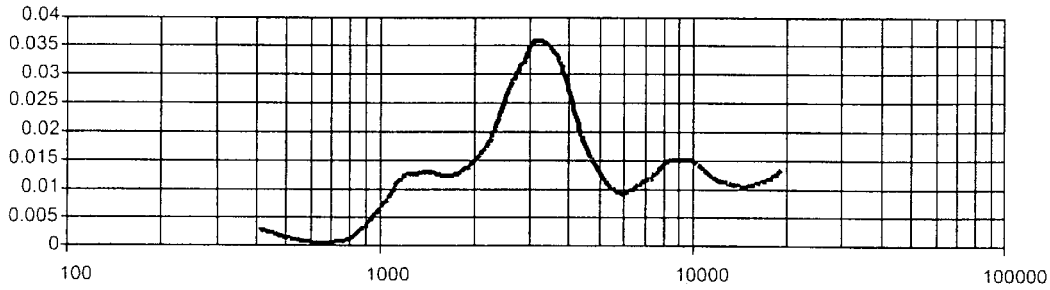
FIG. 17 is a graph showing the damping factor for a beam with a damping strip applied.

In this case, a low modulus PVC foam, which is predominantly closed cells, is applied in strips of width 5 mm along the length of a beam of Table 1. This foam strip has a resonant frequency dependent upon the thickness, compression modulus, material damping and density of this strip. FIG. 17 shows the damping factor for the beam (Table 1) with a single strip of low modulus foam applied along the beam length.

FIG. 17 indicates a resonance of the foam strip at approximately 3.3 kHz which has enhanced the damping of the beam considerably around this frequency. The foam resonance has effectively increased the energy absorption for this arrangement.

Figure 18:
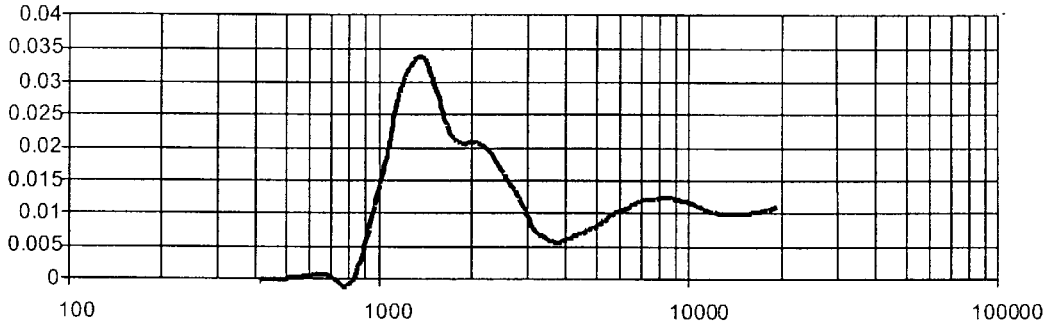
FIG. 18 is a graph showing the damping factor for a beam with two damping strips applied.

When two strips of the low modulus foam used in the previous example, are placed on top of each other and along the beam length, the absorption frequency of the foam changes as shown in FIG. 18. From Equation 3, for optimum absorption it can be seen that the effective stiffness of the foam should be reduced by a factor of 2 if the mass of the free layer is doubled, resulting in a factor of 2 reduction in the absorption frequency.

Comparing FIGS. 17 and 18, it is clear that the reduction in resonant frequency is approximately a factor of 2 as predicted from Equations 2 & 3.

Figure 19:
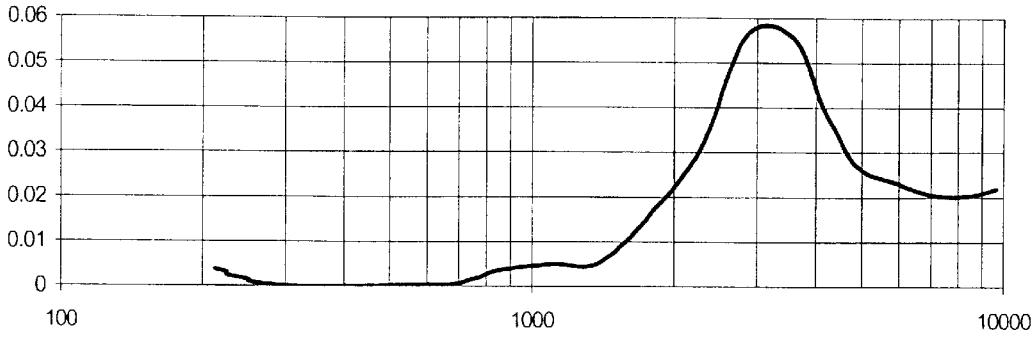
FIG. 19 is a graph showing the damping factor for a beam with three damping strips applied.

By applying three strips of foam alongside each other on the beam, the absorption frequency remains the same but the peak is broadened due to the increased damping i.e. effective energy absorption. FIG. 19 shows this effect.

The peak damping factor is approx. 0.058 with three strips of foam alongside each other but the absorption frequency is approx. 3.3 kHz. This compares with a smaller peak damping factor of approx. 0.036 at approx. 3.3 kHz for the single strip of foam.

Sorbothane Edge Termination

Figure 20:
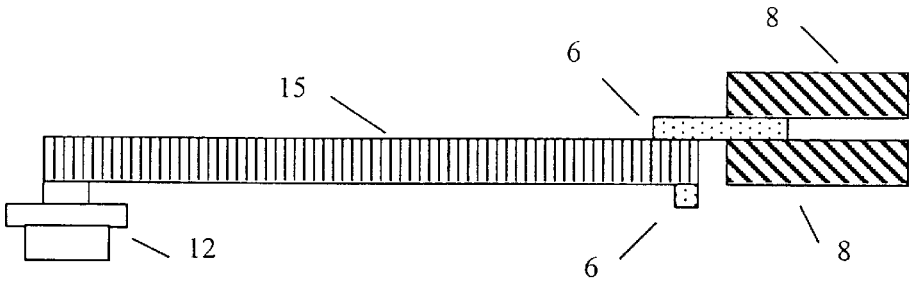
FIG. 20 is a schematic diagram of an edge terminated bending wave beam.
Figure 21:
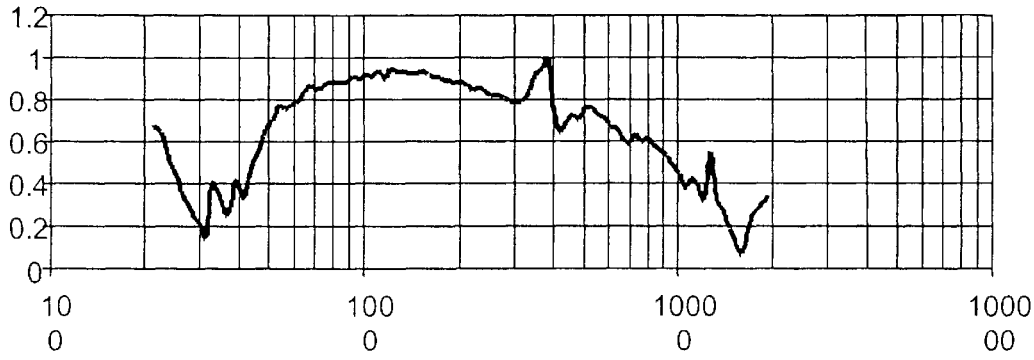
FIG. 21 is a graph showing the reflection coefficient amplitude of the beam of FIG. 20.

The effects of adding an edge termination to a panel are dealt with comprehensively above. By applying two strips of Sorbothane 6, which is a high mechanical loss compliant polymer of polyurethane, to the edge of a beam 15 of Table 1 as shown in FIG. 20, a useful degree of energy absorption was achieved. The dimensions of the strips and of the gap between the beam end and the frame 8 may be optimised to absorb energy below 500 Hz and above 6 kHz as shown in FIG. 21, which shows the reflection coefficient for these edge terminations on a beam.

Damping Treatments Applied to Panel

This section aims to show the effect of the three treatments as described above, i.e. filled polymer layer, low modulus foam strips and edge treatments, on the modal behaviour and acoustic performance for a panel of Table 1.

Figure 22A:
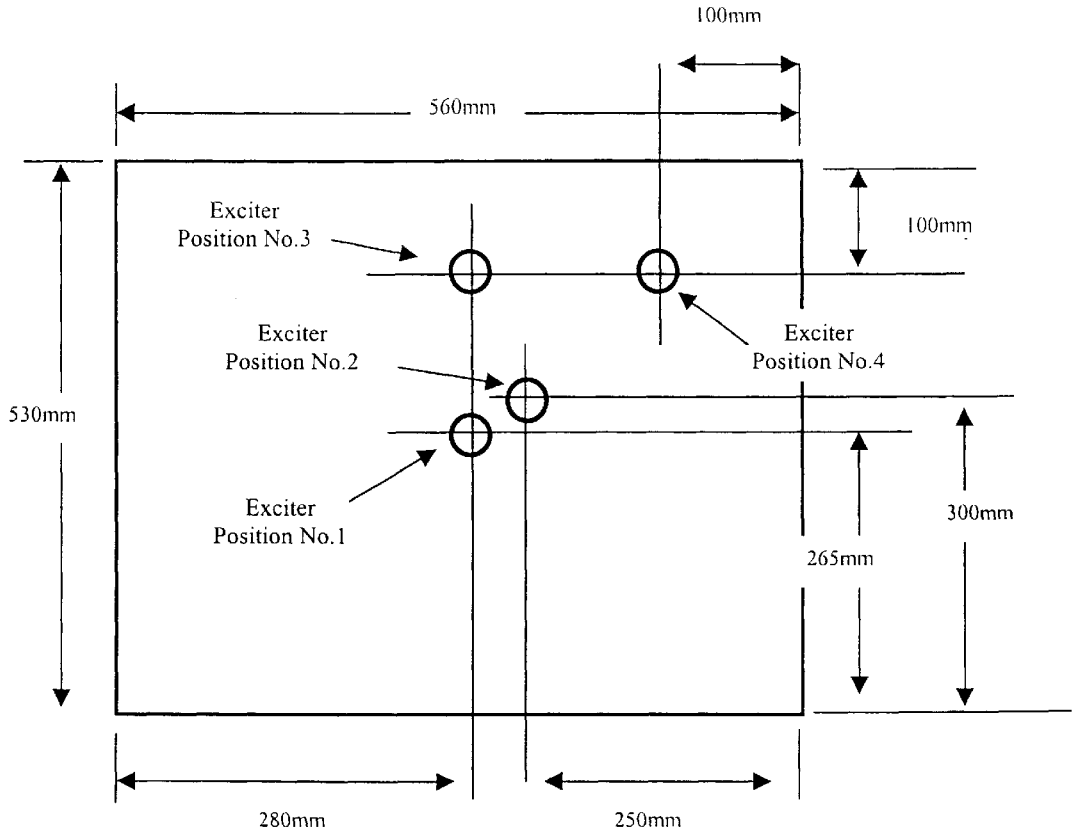
FIG. 22*a* is a rear elevational view of an experimental panel.
Figure 22B:
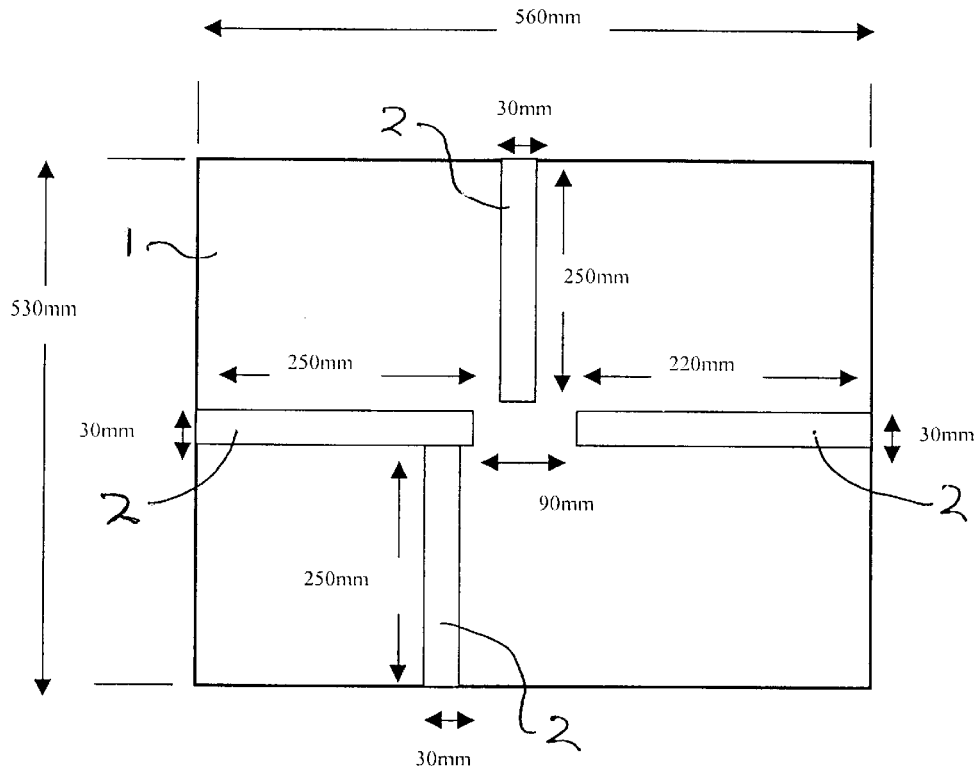
FIG. 22*b* is a front view of the panel of FIG. 22*a* and showing an arrangement of damping strips.

FIG. 22*a* shows the panel size and the four exciter positions used in these vibrations. For the panel shown, a single electrodynamic exciter (25 mm diameter) was placed in turn in each of the four positions as shown and the drivepoint velocity and on-axis acoustic pressure were measured. These measurements were repeated with the three treatments as described above applied to this panel. These treatments are listed here:

1. Filled polymer layer applied over whole panel surface on 1 side;
2. Low modulus foam strips (3 strips each of single & double layers applied on 1 side of panel in spoke-like configuration (strip length=560 mm) across panel midpoints), see FIG. 22*b;* and
3. Sorbothane edge condition as detailed in FIG. 20 along whole perimeter of panel.

Drivepoint Velocity Measurements

The modal distribution excited in a panel is best shown by the velocity characteristic at the drive point, when the panel is excited with a constant force. The degree of smoothness of the velocity is used to demonstrate success in removal of the modes in the panel.

The drivepoint velocities for a free panel and the damping-treatment panel are shown in FIGS. 27–30. The exciter positions for each figure are summarised below (measured from bottom left corner, see FIG. 26*a*) in a panel measuring 560 mm by 530 mm

Figure 23:
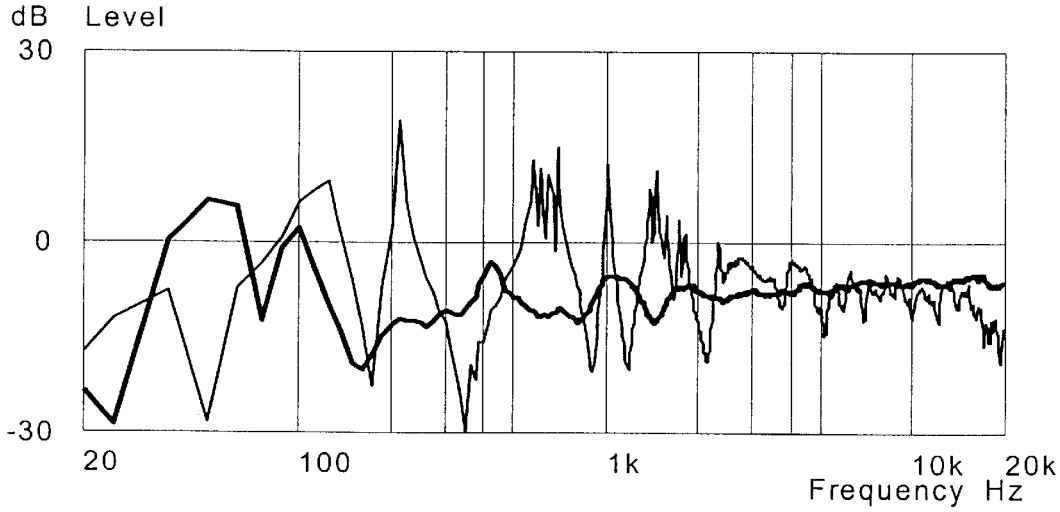
FIGS. 23 to 26 are graphs showing the drive point velocity for the panel of FIG. 22*a* at its different drive points.
Figure 24:
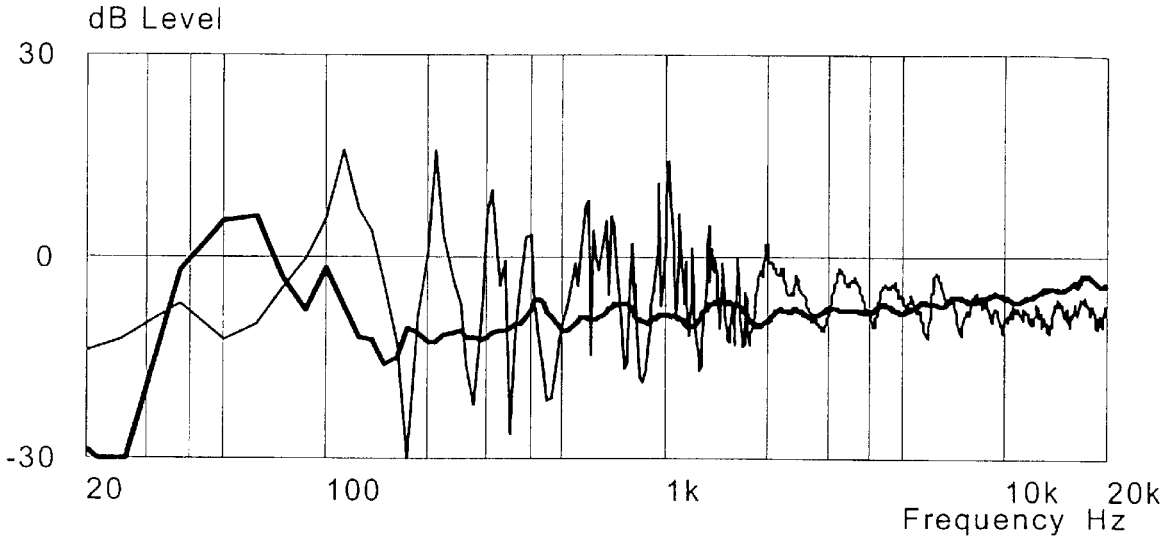
Figure 25:
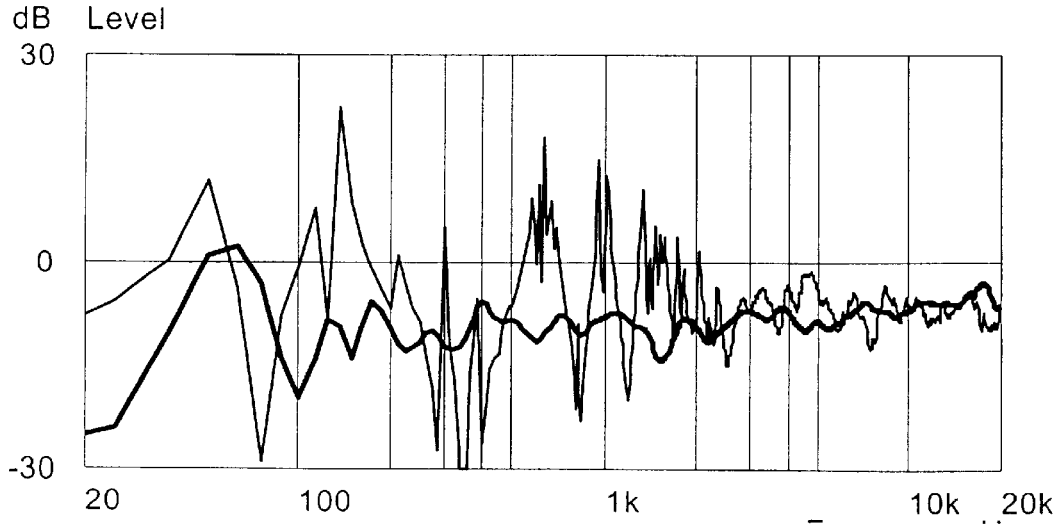
Figure 26:
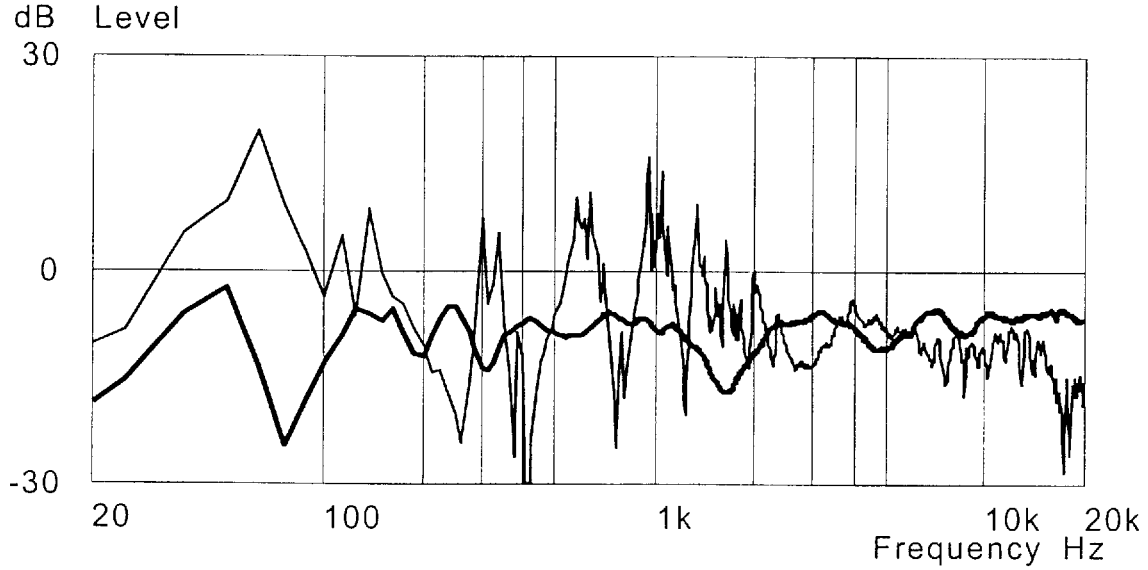

| | |
|---|---|
| FIG. 23 | Panel Midpoint (280 mm, 265 mm) |
| FIG. 24 | 4/9Lx, 3/7Ly Position (310 mm, 300 mm) |
| FIG. 25 | Panel Edge Midpoint (280 mm, 430 mm) |
| FIG. 26 | Panel Corner (460 mm, 430 mm) |

From FIGS. 23 to 26, the effect of the various damping treatments on the modal behaviour of the panel is clear. Namely, the effect of exciter position is much reduced with damping treatments. The sharp, low damping (high Q) modes of the free panel have been significantly reduced by the damping treatments with the result that the velocity at the exciter drivepoint is now relatively smooth and flat with frequency up to 20 kHz.

On-axis Acoustic Pressure Measurements

Figure 27:
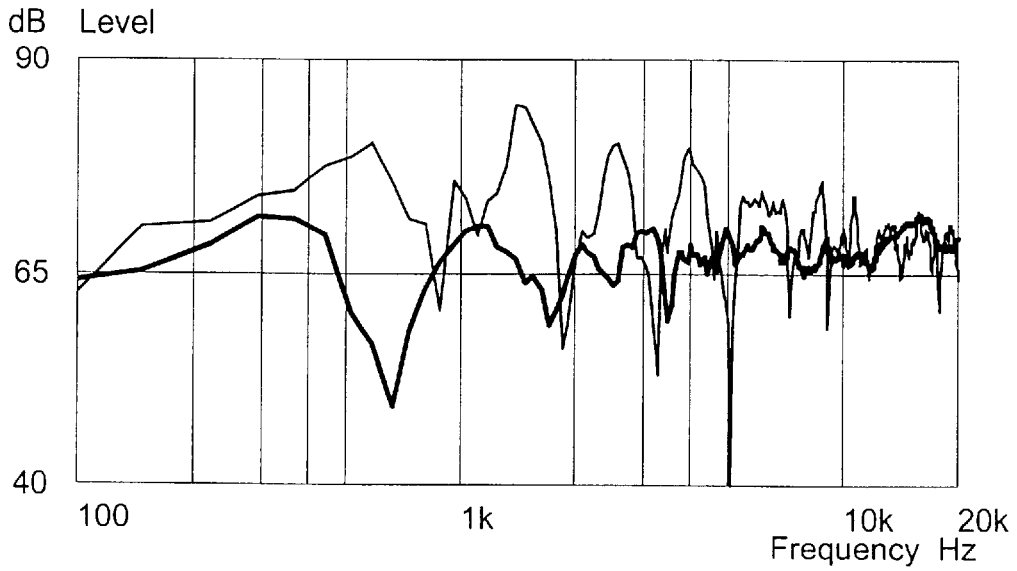
FIG. 27 is a graph showing the acoustic pressure of the panel of FIG. 22*a;*

FIG. 27 shows the on-axis acoustic pressure for the free panel versus the damping-treated panel for exciter position 1 (panel midpoint).

From FIG. 27, it is clear that the low damping modes present in the free panel have been considerably reduced in magnitude by the damping treatments applied to the panel.

When the modal behaviour of this panel in FIG. 23 is compared to the acoustic response of the panel shown in FIG. 27, it is clear that there is more variation visible in the acoustic response. This is due to effects such as diffraction and radiation not shown from the velocity measurements.

a) The models of the free layer damping technique and edge damping treatments for energy absorption show useful action verified experimentally for a range of panel materials and energy absorption treatments.
b) With the application of energy absorption treatments, the modal activity of a panel can be significantly reduced.
c) Analysis of the reflection coefficient and system damping factor for a simple beam model facilitates the prediction of the effects of different treatments on the behaviour of a panel.

Effect of Changes in Shape/Form of Edge Terminations on the Reflection Coefficient The effects of changes in foam shape on the reflection coefficient (amplitude and phase) and damping factor for the carbon fibre aluminium honeycomb beam described above may be examined, for example, the effect of shape on free layers.

Strips of soft low modulus PVC foam are applied to the end of a beam of Table 1 across the full width of the beam in different configurations as shown in FIGS. 28*a* to 28*f*. For the configurations of FIGS. 28*d* to 28*f*, a continuous block or wedge of foam is applied to the beam. For all of these configurations the beam is in the free configuration i.e. no load or compression is applied to the edge condition. The corresponding FIGS. 29*a* to 29*f* show the reflection coefficients for those configurations.

Figure 28A:
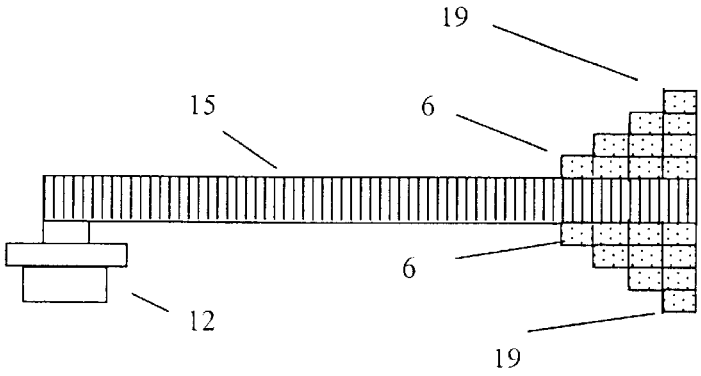
FIGS. 28*a* to 28*f* are schematic diagrams showing various configurations of edge termination of a beam.
Figure 29A:
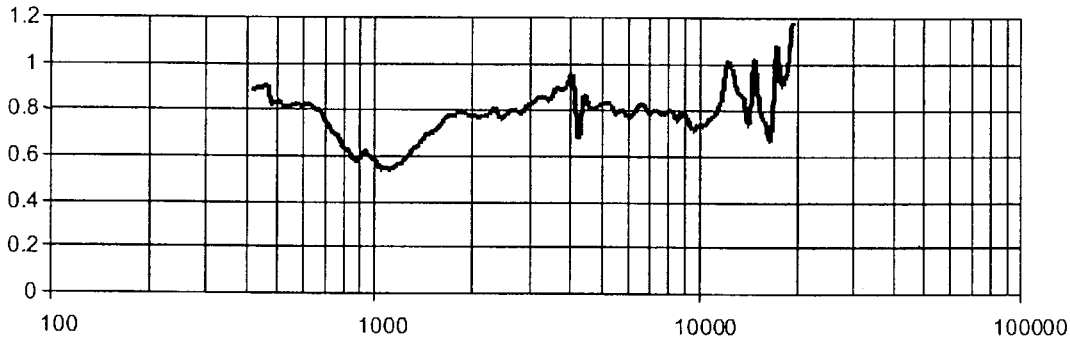
FIGS. 29*a* to 29*f* are graphs showing the reflection coefficient amplitude for the configurations of edge terminations of FIGS. 28*a* to f respectively.

In FIG. 28*a*, square section strips 19 of low modulus PVC foam are applied to both faces of the end of the beam in four separate layers of four, three, two and one strips, as shown.

Figure 28B:
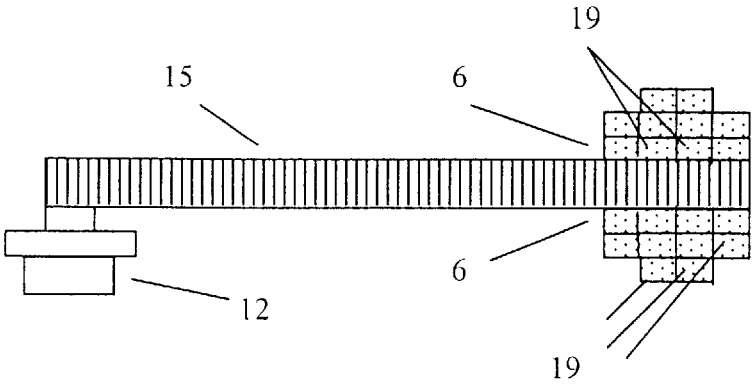
Figure 29B:
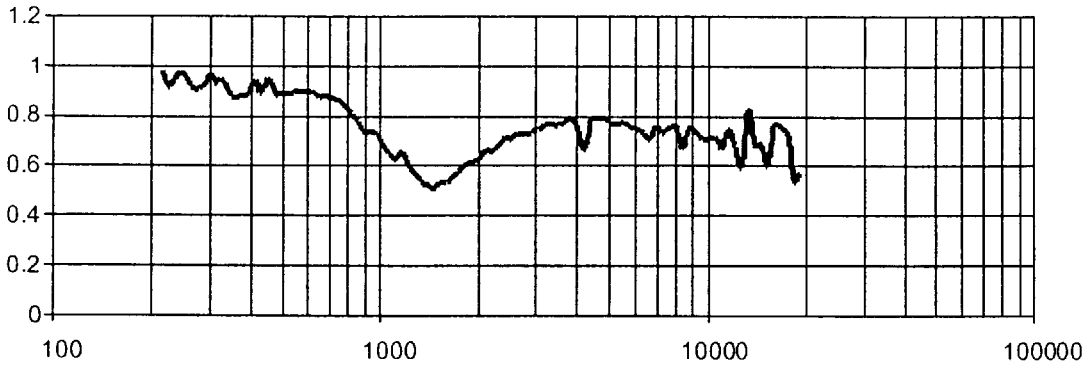

FIG. 28*b* has the same number of strips as that of the configuration of FIG. 28*a* but a different arrangement of three layers, the base layer and intermediate layers being of four strips and the top layer being of two strips, as shown.

Figure 28C:
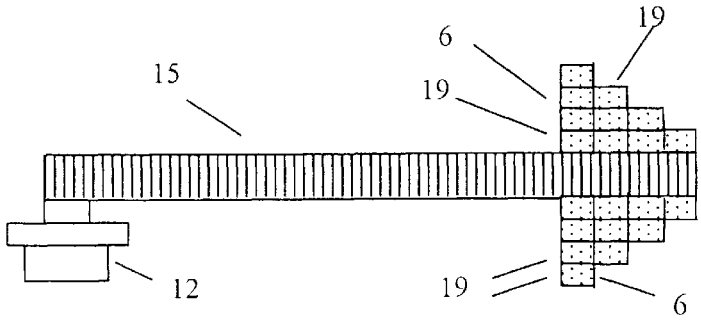
Figure 29C:
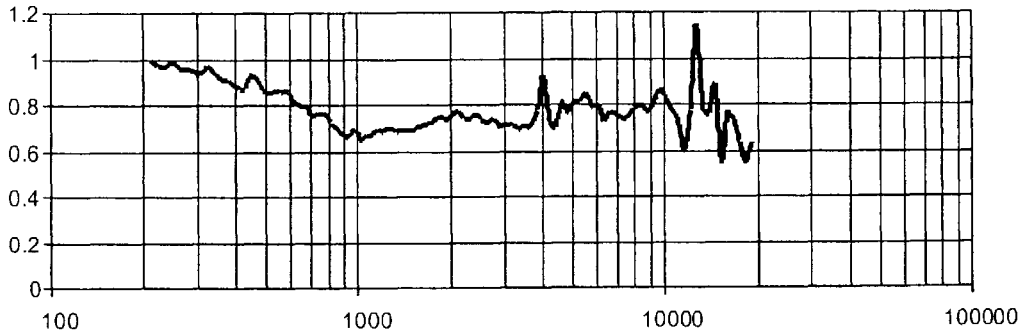

The configuration of FIG. 28*c* is similar to that of FIG. 28*b*, but with the arrangement of the strips of foam reversed.

Figure 28D:
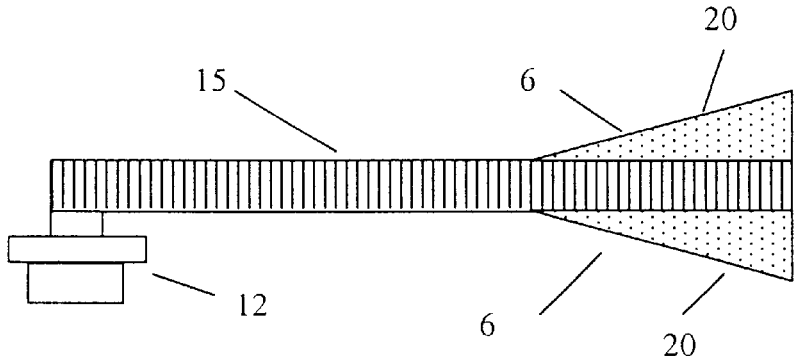
Figure 29D:
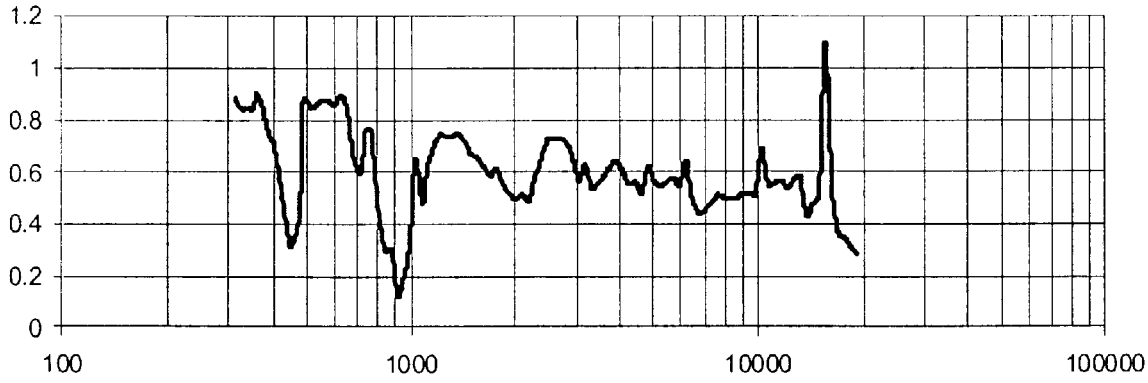

The configuration of FIG. 28*d* comprises an opposed pair of low modulus PVC foam wedges 20 fixed to the opposed faces of the end of the beam.

Figure 28E:
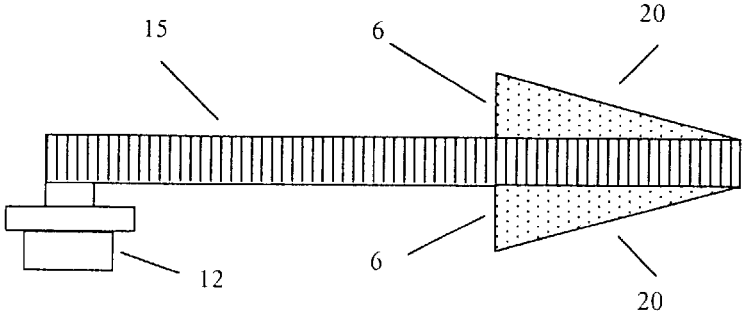
Figure 29E:
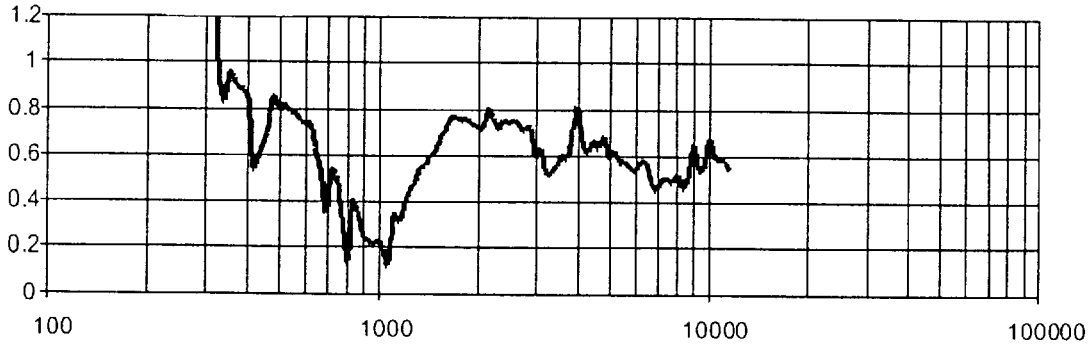

The configuration of FIG. 28*e* is similar to that of FIG. 28*d*, but with the direction of the foam wedges 20 reversed.

Figure 28F:
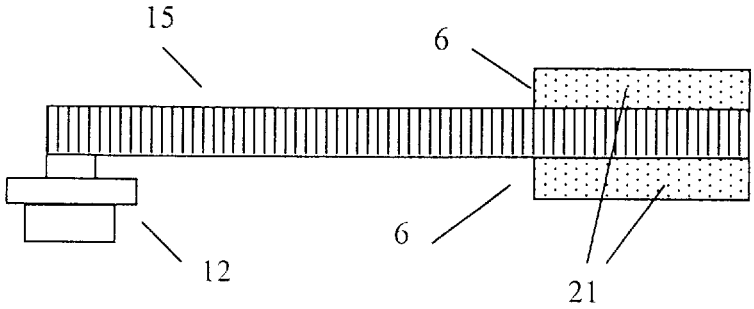
Figure 29F:
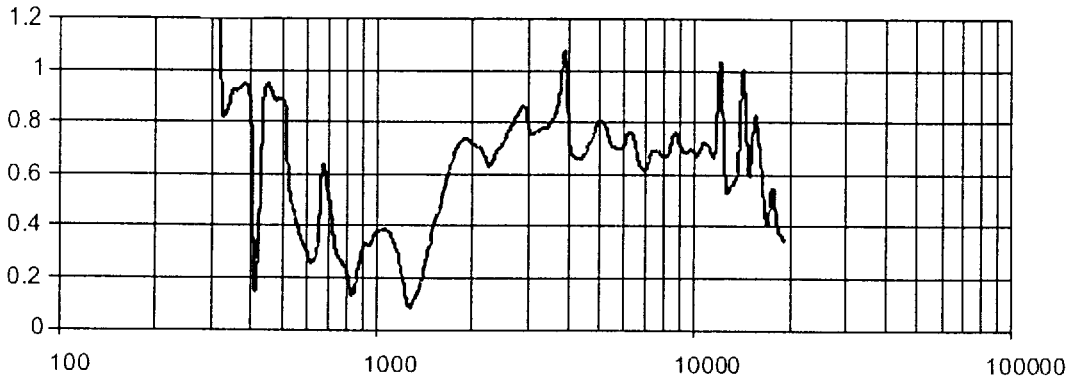

The configuration of FIG. 28*f* is similar to that of FIGS. 28*d* and 28*e*, but with the foam wedges replaced by rectangular section low modulus PVC foam blocks 21. The foam blocks used in this configuration have an identical volume and therefore mass as the wedges of foam used in the configurations of FIGS. 28*d* and 28*e*.

Effect of Shape on Restrained Layers

For the continuous wedges and blocks of foam used in the configurations of FIGS. 28*a* to 28*f*, the analysis was repeated but with the addition of compression applied to the foam blocks or wedges via frame members 8.

Figure 30A:
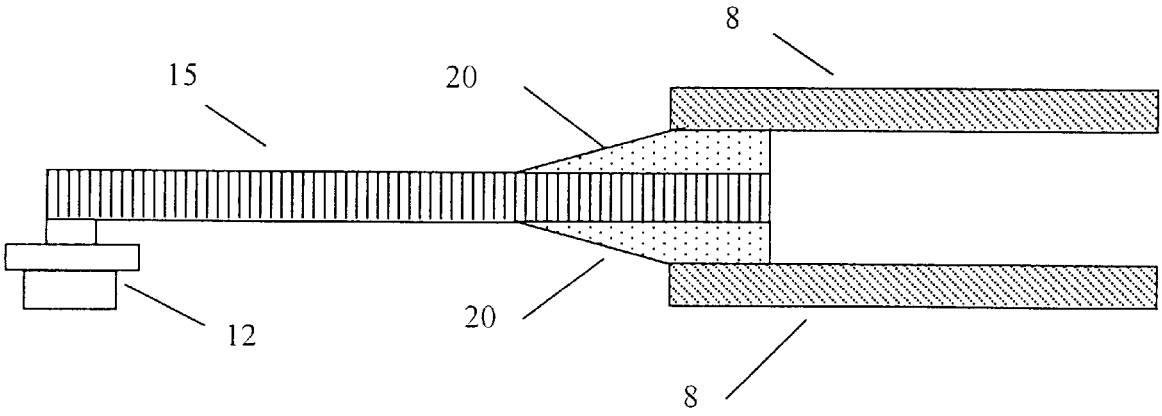
FIGS. 30*a* to 30*c* are schematic diagrams showing various configurations of compressed edge termination of a beam.
Figure 31A:
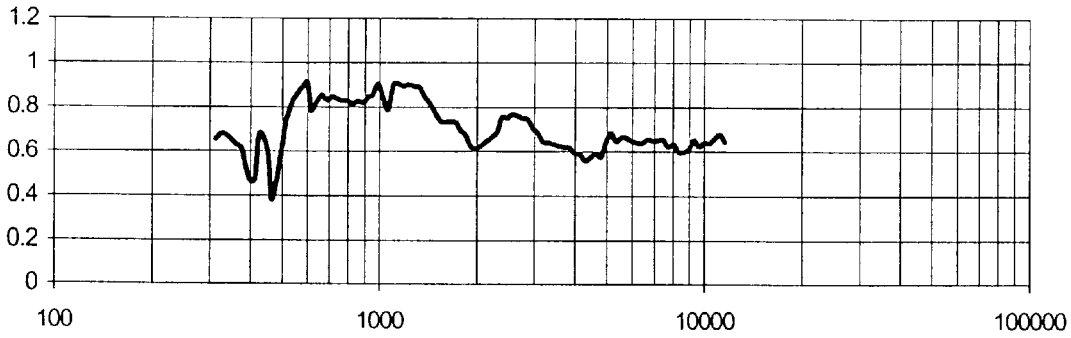
FIGS. 31*a* to 31*c* are graphs showing the reflection coefficient amplitude for the configurations of edge termination of FIGS. 30*a* to *c* respectively.

The configuration of FIG. 30*a* uses the same wedge blocks 20 as used in the configuration of FIG. 28*d* but with the foam edge compressed to 10 mm thickness from its original thickness of 28 mm.

Figure 30B:
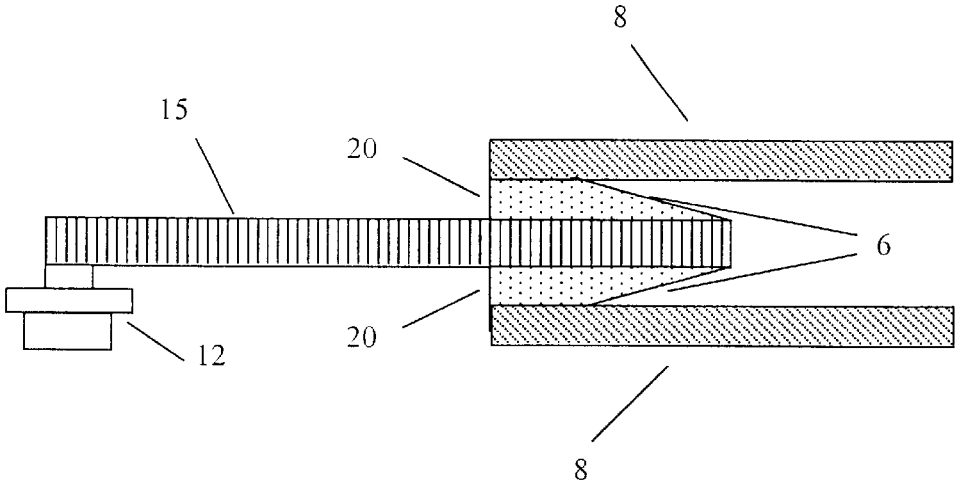
Figure 31B:
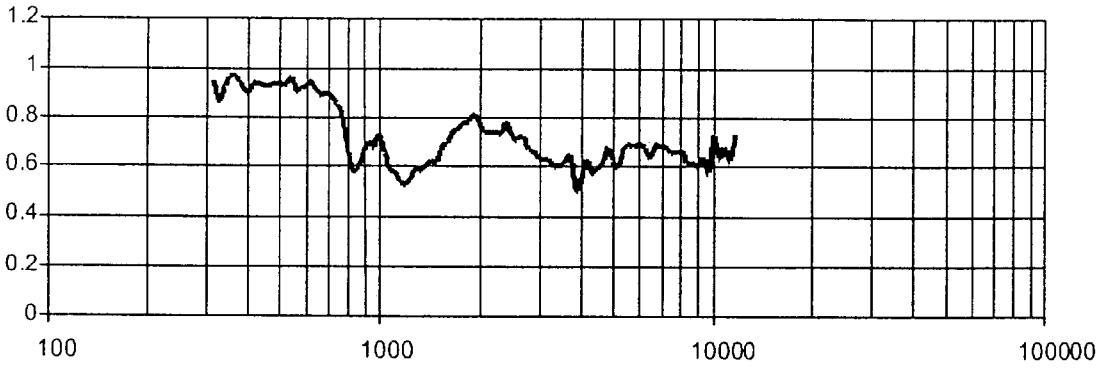

The configuration of FIG. 30*b* uses the same wedge blocks 20 as in the configuration of 28*e* but with the foam edge compressed to 10 mm thickness from its original thickness of 28 mm.

Figure 30C:
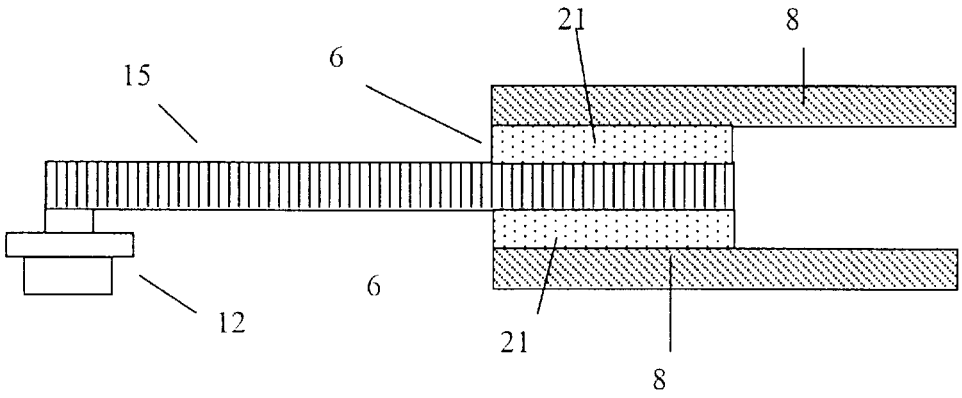
Figure 31C:
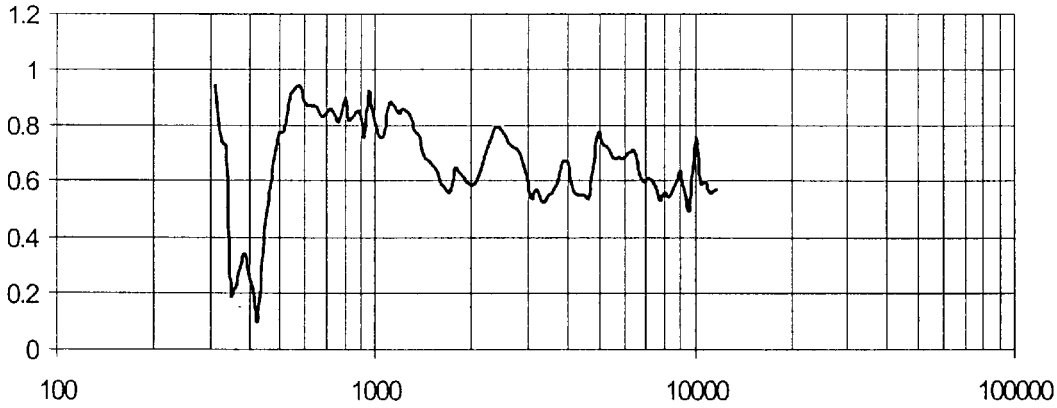

The configuration of FIG. 30*c* uses the same rectangular blocks 21 as in the configuration of FIG. 28*f* but with the foam edge compressed to 10 mm thickness from its original thickness of 14 mm.

It is clear that the shape and form of the edge termination has a great effect on the energy absorption characteristics of the boundary condition. From a comparison of the absorption characteristics of the configurations of FIGS. 28*a* and 28*b*, it appears that the height of the discrete absorbers affects the absorption which is associated with the resonant frequency of these blocks as described above. The configuration of FIG. 28*a* has an absorption trough centred around a lower frequency than the configuration of FIG. 28*b* because it has a greater maximum height of foam, i.e. 4 blocks rather than 3.

Clamping or constraining the foam blocks significantly changes the absorption characteristics of the edge compared to the free case for all foam/beam configurations. Clearly, the edge impedance is significantly altered by the compression of the foam and this affects the absorption characteristics.

For all cases examined, the foams applied produced a useful level of broadband energy absorption above approximately 2 kHz. This is shown by the amplitude of the reflection coefficient varying between 0.6 to 0.8 above this frequency.

Benefits of a loudspeaker of the present invention may include the following:

1. The panel produces all frequencies equally throughout its operating frequency range and does not suffer from sparse modality in the lower range, as is possible in the case for a DML.
2. Panel shape and geometry has little or no influence on the performance of the loudspeaker. Indeed, and unlike a DML, an axisymmetrically driven strategy can be a preferred method of excitation. In fact a circular panel excited in the middle may provide the most effective solution with uniform termination across the whole perimeter.
3. Exciter placement becomes substantially non critical as long as it is not positioned too close to the boundaries of the panel in the case of the edge-terminated method.
4. Mechanical impedance at the driving point is constant and smooth—without the imprint of the modes sometimes experienced in a DML speaker—approaching the ideal infinite-size panel behaviour.

5. The radiation characteristic and the effective radiating area can be configured to suit the application with the choice of an appropriate damping strategy, i.e. its magnitude and frequency dependence.
6. The low-frequency output level may be controlled to suit the application by moving the exciter(s) away from the centre of the panel to provide reduced LF power.
7. The application of damping to control modal behaviour reduces the sensitivity of performance to exciter location, and may now include central location.

What is claimed is:

1. A loudspeaker comprising a panel which is sufficiently stiff to support bending waves, the panel having a boundary, a transducer mounted to the panel to apply bending wave energy in the form of dispersive travelling waves thereto at a first location in response to an electrical signa applied to the transducer to cause the panel to vibrate and radiate an acoustic output, the loudspeaker having a frequency range extending from a lower frequency to a higher frequency and the panel having a stiffness giving a coincidence frequency above the lower frequency, and comprising means on or associated with the panel at a second location to attenuate travelling bending waves in the panel at least substantially to moderate panel resonance, the attenuating means comprising mechanical impedance means at a panel boundary which is matched to the mechanical impedance of the panel to provide absorption of bending wave energy reaching the panel boundary at a frequency within the operating frequency range of the panel.

2. A loudspeaker according to claim 1, wherein the attenuating means is located on or in the panel to attenuate bending wave energy before it reaches the panel boundary.

3. A loudspeaker according to claim 2, wherein the attenuating means is frequency dependent.

4. A loudspeaker according to claim 3, wherein the frequency dependence is such that higher frequencies of bending wave energy are reflected from the panel boundary.

5. A loudspeaker according to claim 2, wherein the mechanical impedance means extends round substantially the entire panel boundary.

6. A loudspeaker according to claim 2, wherein the attenuating means comprises a predetermined stiffness or structural mechanical impedance profile across the panel.

7. A loudspeaker according to claim 1, wherein the mechanical impedance means increases bending wave energy absorption at, or bending wave energy transfer across, at least a portion of a boundary of the panel.

8. A loudspeaker according to claim 6, wherein the attenuating means provides a non-uniform mechanical impedance profile across at least a portion of the panel.

9. A loudspeaker according to claim 8, wherein the attenuating means provides an increase in attenuation towards a boundary of the panel.

10. A loudspeaker according to claim 9, wherein the attenuation means provides a reduction in attenuation towards the centre of the panel.

11. A loudspeaker according to claim 6, wherein the attenuating means has a mechanical impedance which is substantially matched to the mechanical impedance at an interface between at least a portion of the panel and a frame for the panel.

12. A loudspeaker according to claim 6, wherein the attenuating means comprises a variation in panel thickness or density across at least a portion of the panel.

13. A loudspeaker according to claim 6, wherein the attenuating means comprises a layer over one or both surfaces of the panel and/or incorporate within the panel.

14. A loudspeaker according to claim 1, wherein the bending wave panel comprises a termination provided at or towards at least a portion of a panel boundary.

15. A loudspeaker according to claim 14, wherein the termination has a predetermined mechanical impedance for substantially matching a mechanical impedance of at least a portion of the panel to an impedance of a portion of a frame for the panel.

16. A loudspeaker according to claim 15, wherein the termination has a predetermined mechanical resistance for reducing the energy of a bending wave moving towards a panel boundary.

17. A loudspeaker according to claim 14, wherein the termination has a predetermined mechanical resistance for reducing the energy of a bending wave moving towards a panel boundary.

18. A loudspeaker as claimed in claim 2, wherein the first location is substantially at the panel centre.

19. A loudspeaker according to claim 1, wherein the attenuating means comprises a predetermined stiffness or structural mechanical impedance profile across the panel.

20. A loudspeaker according to claim 19, wherein the attenuating means provides a non-uniform mechanical impedance profile across at least a portion of the panel.

21. A loudspeaker according to claim 20, wherein the attenuating means provides an increase in attenuation towards a boundary of the panel.

22. A loudspeaker according to claim 21, wherein the attenuation means provides a reduction in attenuation towards the centre of the panel.

23. A loudspeaker according to claim 19, wherein the attenuating means has a mechanical impedance which is substantially matched to the mechanical impedance at an interface between at least a portion of the panel and a frame for the panel.

24. A loudspeaker according to claim 19, wherein the attenuating means comprises a variation in panel thickness or density across at least a portion of the panel.

25. A loudspeaker according to claim 6, wherein the attenuating means comprises a layer over one or both surfaces of the panel and/or incorporated within the panel.

26. A loudspeaker according to claim 19, wherein the bending wave panel comprises a termination provided at or towards at least a portion of a panel boundary.

27. A loudspeaker according to claim 19, wherein the termination has a predetermined mechanical impedance for substantially matching a mechanical impedance of at least a portion of the panel to an impedance of a portion of a frame for the panel.

28. A loudspeaker according to claim 19, wherein the termnation has a predetermined mechanical resistance for reducing the energy of a bending wave moving towards a panel boundary.

29. A microphone comprising a panel which is sufficiently stiff to support bending waves, the panel having a boundary, a transducer mounted to the panel to produce an electrical signal in response to bending wave energy in the form of dispersive travelling waves in the panel caused by incident acoustic radiation, the microphone having a frequency range extending from a lower frequency to a higher frequency and the panel having a stiffness giving a coincidence frequency above the lower frequency, and comprising means on or associated with the panel to attenuate travelling bending waves in the panel at a frequency within the operating frequency range of the panel at least substantially to moderate panel resonance, the attenuating means acting in the manner of an acoustic aperture over an infinite bending plate.

30. An acoustic device comprising a panel which is sufficiently stiff to support bending waves, the panel having a boundary, the device having a frequency range extending from a lower frequency to a higher frequency and the panel having a stiffness giving a coincidence frequency above the lower frequency and comprising means on or associated with the panel to attenuate travelling bending waves in the panel at a frequency within the operating frequency range of the panel at least substantially to moderate panel resonance, the attenuating means acting in the manner of an acoustic aperture over an infinite bending plate.

* * * * *